US006266508B1

(12) United States Patent
Nakagawa et al.

(10) Patent No.: US 6,266,508 B1
(45) **Date of Patent: *Jul. 24, 2001**

(54) DEVELOPING APPARATUS INCLUDING AN AC VOLTAGE APPLYING DEVICE

(75) Inventors: Shuichi Nakagawa, Suita; Hiroshi Goto, Kawanishi; Tateki Oka, Toyohashi, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/504,798

(22) Filed: Feb. 15, 2000

(30) Foreign Application Priority Data

| | | |
|---|---|---|
| Feb. 25, 1999 | (JP) | 11-047898 |
| Feb. 25, 1999 | (JP) | 11-047899 |
| Mar. 15, 1999 | (JP) | 11-068562 |
| Mar. 15, 1999 | (JP) | 11-068563 |
| Mar. 30, 1999 | (JP) | 11-089609 |

(51) Int. Cl.[7] ..... G03G 15/08
(52) U.S. Cl. ..... 399/285; 399/286; 430/120
(58) Field of Search ..... 399/55, 270, 285, 399/286, 276, 279; 430/120, 122

(56) References Cited

U.S. PATENT DOCUMENTS

| | | | | |
|---|---|---|---|---|
| 3,987,756 | | 10/1976 | Katayama et al. | 118/637 |
| 4,610,531 | * | 9/1986 | Hayashi et al. | 399/270 |
| 5,194,359 | | 3/1993 | Kanbe et al. | 430/120 |
| 5,324,884 | * | 6/1994 | Honda et al. | 399/279 |
| 5,424,812 | * | 6/1995 | Kemmochi et al. | 399/270 |
| 5,532,801 | * | 7/1996 | Mizoguchi | 399/232 |
| 5,893,014 | * | 4/1999 | Goto et al. | 399/286 |
| 6,070,040 | * | 5/2000 | Goto et al. | 399/285 |

FOREIGN PATENT DOCUMENTS

| | | | |
|---|---|---|---|
| 61-166558 | * | 7/1986 | (JP) . |
| 1-257970 | * | 10/1989 | (JP) . |

* cited by examiner

*Primary Examiner*—Joan Pendegrass
(74) *Attorney, Agent, or Firm*—Burns, Doane, Swecker & Mathis, LLP

(57) ABSTRACT

A developing apparatus according to the present invention comprises a developer carrying member for holding a developer and introducing the developer into a developing area opposite to the image carrying member at a required distance; a voltage applying device for applying an AC voltage to the developer carrying member; and a resistor inserted between the developer applying device and the developer carrying member, the AC voltage applied to the developer carrying member from the voltage applying device through the resistor being composed of a rectangular wave, and a time period during which a voltage, which is exerted in the direction in which the developer is fed to the image carrying member, in the AC voltage is less than 50% of a time period during which the AC voltage is exerted.

27 Claims, 23 Drawing Sheets

DEVELOPING APPARATUS INCLUDING AN AC VOLTAGE APPLYING DEVICE

BACKGROUND OF THE INVENTION

This application is based on applications Nos. 47898/1999, 47899/1999, 68562/1999, 68563/1999 and 89609/1999 filed in Japan, the contents of which is hereby incorporated by reference.

1. Field of the Invention

The present invention relates generally to a developing apparatus used for developing an electrostatic latent image formed on an image carrying member in an image forming apparatus such as a copying machine or a printer, and more particularly, to a developing apparatus in which a developer carrying member for holding a developer and an image carrying member having an electrostatic latent image formed thereon are provided so as to be opposite to each other at a required distance and so adapted that an AC voltage is applied to the developer carrying member to exert an AC electric field between the developer carrying member and the image carrying member, and the developer held in the developer carrying member is supplied to the electrostatic latent image formed on the image carrying member to perform development, characterized in that the density of an image to be formed does not greatly vary even when a distance at which the developer carrying member and the image carrying member are opposite to each other varies, thereby obtaining a good image having a stable image density.

2. Description of the Related Art

In an image forming apparatus such as a copying machine or a printer, various developing apparatuses have been conventionally used for developing an electrostatic latent image formed on an image carrying member.

Known as such a developing apparatus have been a developing apparatus of a contact development type, in which a developer carrying member is provided so as to be brought into contact with an image carrying member, and a developer is introduced into a developing area in contact with the image carrying member by the developer carrying member to perform development, and a developing apparatus of a non-contact development type, in which a developer carrying member is provided so as to be opposite to an image carrying member at a required distance, a developer is introduced into a developing area opposite to the image carrying member by the developer carrying member, an AC voltage is applied to the developer carrying member to exert an AC electric field between the developer carrying member and the image carrying member, and therefore the developer is supplied to an electrostatic latent image formed on the image carrying member to perform development.

The developing apparatus of a contact development type is superior in reproducibility of an electrostatic latent image formed on the image carrying member because the developer is brought into contact with the image carrying member to perform development. However, there are some problems. For example, the developer also adheres to a non-image portion where no electrostatic latent image is formed, so that an image to be formed is fogged, and the surface of the image carrying member is worn by the developer carrying member.

On the other hand, in the case of the developing apparatus of a non-contact development type in which the developer carrying member is provided so as to be opposite to the image carrying member at a required distance, the above-mentioned problems in the developing apparatus of a contact development type are reduced.

In the case of the developing apparatus of a non-contact development type, however, the distance at which the image carrying member and the developer carrying member are opposite to each other may, in some cases, vary due to inferior forming precision, mounting precision, and so forth of the image carrying member and the developer carrying member. When the distance at which the developer carrying member and the image carrying member are opposite to each other is decreased, the AC electric field exerted between the developer carrying member and the image carrying member is strengthened, so that the density of an image to be formed is increased. On the other hand, when the distance at which the developer carrying member and the image carrying member are opposite to each other is increased, the AC electric field exerted between the developer carrying member and the image carrying member is weakened, so that the density of the image to be formed is decreased. Consequently, the density of the image to be formed becomes non-uniform, thereby making it possible to obtain a good image having a stable image density.

SUMMARY OF THE INVENTION

An object of the present invention is to prevent, in a developing apparatus for holding a developer in a developer carrying member, introducing the developer into a developing area opposite to an image carrying member at a required distance, applying an AC voltage to the developer carrying member, and supplying the developer to an electrostatic latent image formed on the image carrying member from the developer carrying member to perform development, the amount of the developer supplied to the image carrying member from varying when a distance at which the developer carrying member and the image carrying member are opposite to each other varies, to prevent an image to be formed from being non-uniform in density, thereby stably obtaining a good image having a constant image density.

A first developing apparatus according to the present invention for developing an electrostatic latent image formed on an image carrying member comprises a developer carrying member for holding a developer and introducing the developer into a developing area opposite to the image carrying member at a required distance; a voltage applying device for applying an AC voltage to the developer carrying member; and a resistor inserted between the voltage applying device and the developer carrying member, the AC voltage applied to the developer carrying member from the voltage applying device through the resistor being composed of a rectangular wave, and a time period during which a voltage, which is exerted in the direction in which the developer is fed to the image carrying member, in the AC voltage being less than 50% of a time period during which the AC voltage is exerted.

A second developing apparatus according to the present invention for developing an electrostatic latent image formed on an image carrying member comprises a developer carrying member for holding a developer and introducing the developer into a developing area opposite to the image carrying member at a required distance; and a voltage applying device for applying an AC voltage to the developer carrying member, the developer carrying member being provided with a resistor layer, the AC voltage applied to the developer carrying member provided with the resistor layer from the voltage applying device being composed of a rectangular wave, and a time period during which a voltage, which is exerted in the direction in which the developer is fed to the image carrying member, in the AC voltage being less than 50% of a time period during which the AC voltage is exerted.

A third developing apparatus according to the present invention for developing an electrostatic latent image formed on an image carrying member comprises a developer carrying member for holding a developer and introducing the developer into a developing area opposite to the image carrying member at a required distance; and a voltage applying device for applying an AC voltage composed of a rectangular wave to the developer carrying member, a resistor and a rectifier element being connected in parallel between the voltage applying device and the developer carrying member, and the rectifier element being connected in such a direction as to cut off a current caused by a voltage, which is exerted in the direction in which the developer is fed to the image carrying member, in the AC voltage composed of the rectangular wave.

A fourth developing apparatus according to the present invention for developing an electrostatic latent image formed on an image carrying member comprises a developer carrying member for holding a developer and introducing the developer into a developing area opposite to the image carrying member at a required distance; a voltage applying device for applying an AC voltage to the developer carrying member; and a resistor inserted between the voltage applying device and the developer carrying member, the AC voltage applied to the developer carrying member from the voltage applying device through the resistor being composed of a rectangular wave, and having a constant voltage period during which there is no voltage change while the waveform of the AC voltage is changed from the peak value of a voltage, which is exerted in the direction in which the developer is returned to the developer carrying member, in the AC voltage to the peak value of a voltage, which is exerted in the direction in which the developer is fed to the image carrying member, in the AC voltage.

A fifth developing apparatus according to the present invention for developing an electrostatic latent image formed on an image carrying member comprises a developer carrying member for holding a developer and introducing the developer into a developing area opposite to the image carrying member at a required distance; and a voltage applying device for applying an AC voltage to the developer carrying member, the developer carrying member being provided with a resistor layer, the AC voltage applied to the developer carrying member provided with the resistor layer from the voltage applying device being composed of a rectangular wave, and having a constant voltage period during which there is no voltage change while the waveform of the AC voltage is changed from the peak value of a voltage, which is exerted in the direction in which the developer is returned to the developer carrying member, in the AC voltage to the peak value of a voltage, which is exerted in the direction in which the developer is fed to the image carrying member, in the AC voltage.

A sixth developing apparatus according to the present invention for developing an electrostatic latent image formed on an image carrying member comprises a developer carrying member for holding a developer and introducing the developer into a developing area opposite to the image carrying member at a required distance; and a voltage applying device for applying an AC voltage composed of a rectangular wave to the developer carrying member, a capacitor, a resistor, and a rectifier element being connected in parallel between the voltage applying device and the developer carrying member, and the rectifier element being connected in such a direction as to cut off a current caused by a voltage, which is exerted in the direction in which the developer is fed to the image carrying member, in the AC voltage composed of the rectangular wave.

A seventh developing apparatus according to the present invention for developing an electrostatic latent image formed on an image carrying member comprises a developer carrying member for holding a developer and introducing the developer into a developing area opposite to the image carrying member at a required distance; a voltage applying device for applying an AC voltage to the developer carrying member; and a resistor inserted between the voltage applying device and the developer carrying member, the AC voltage applied to the developer carrying member from the voltage applying device through the resistor being a pulse-shaped AC voltage, and at least a voltage on the side of development, which is exerted in the direction in which the developer is fed to the image carrying member, in the AC voltage being continuously or gradually decreased from its peak value.

An eighth developing apparatus according to the present invention for developing an electrostatic latent image formed on an image carrying member comprises a developer carrying member for holding a developer and introducing the developer into a developing area opposite to the image carrying member at a required distance; and a voltage applying device for applying an AC voltage to the developer carrying member, the developer carrying member being provided with a resistor layer, the AC voltage applied to the developer carrying member provided with the resistor layer from the voltage applying device being a pulse-shaped AC voltage, and at least a voltage on the side of development, which is exerted in the direction in which the developer is fed to the image carrying member, in the AC voltage being continuously or gradually decreased from its peak value.

In the first to eighth developing apparatuses according to the present invention, in a case where the AC voltage is applied to the developer carrying member provided opposite to the image carrying member at a required distance to perform development, the amount of the developer fed to the image carrying member is prevented from varying even if a distance at which the image carrying member and the developer carrying member are opposite to each other varies.

As a result, if the developing apparatus according to the present invention is employed, a good image which hardly becomes non-uniform in density and has a constant image density is stably obtained even when the distance at which the image carrying member and the developer carrying member are opposite to each other varies.

These and other objects, advantages and features of the invention will become apparent from the following description thereof taken in conjunction with the accompanying drawings which illustrate specific example of the invention.

DESCRIPTION OF THE PREFERRED EMBODIMENTS

In a first developing apparatus according to the present invention, in holding a developer in a developer carrying member to introduce the developer into a developing area opposite to an image carrying member at a required distance, and applying an AC voltage to the developer carrying member from a voltage applying device to develop an electrostatic latent image formed on the image carrying member, an AC voltage composed of a rectangular wave and including a voltage which is exerted in the direction in which the developer is fed to the image carrying member for a time period which is less than 50% of a time period during which the AC voltage is exerted is applied to the developer carrying member from the voltage applying device through a resistor.

In a second developing apparatus according to the present invention, in holding a developer in a developer carrying member to introduce the developer into a developing area opposite to an image carrying member at a required distance, and applying an AC voltage to the developer carrying member from a voltage applying device to develop an electrostatic latent image formed on the image carrying member, the developer carrying member is provided with a resistor layer, and an AC voltage composed of a rectangular wave and including a voltage on the side of development which is exerted in the direction in which the developer is fed to the image carrying member for a time period which is less than 50% of a time period during which the AC voltage is exerted is applied to the developer carrying member provided with the resistor layer from the voltage applying device.

Figure 1:
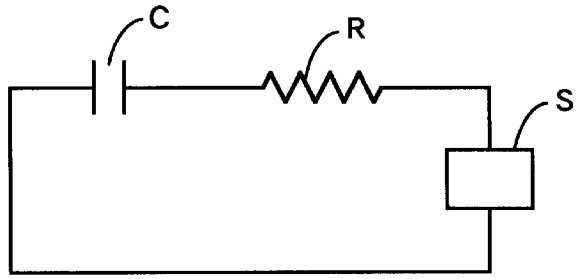
FIG. 1 is a diagram showing an equivalent circuit of a circuit which is constituted by a developing apparatus and an image carrying member in first, second, fourth, fifth, seventh and eighth developing apparatuses according to the present invention.

A case where the AC voltage is applied to the developer carrying member provided opposite to the image carrying member at a required distance from the voltage applying device through the resistor and a case where the AC voltage is applied to the developer carrying member provided with the resistor layer from the voltage applying device, as in the first and second developing apparatuses, are represented as a circuit in which a resistor element R and a capacitor element C comprising an image carrying member and a developer carrying member which are opposite to each other at a required distance are connected in series to a voltage applying device S, as shown in FIG. 1.

In such a circuit, when an AC voltage composed of a rectangular wave is applied from the voltage applying device S, a potential on the surface of the developer carrying member rises with a time constant.

When a distance d at which the image carrying member and the developer carrying member are opposite to each other is decreased, the capacitance of the capacitor element C is increased so that the time constant is increased. On the other hand, when the distance d at which the image carrying member and the developer carrying member are opposite to each other is increased, the capacitance of the capacitor element C is decreased so that the time constant is decreased.

Figure 2:
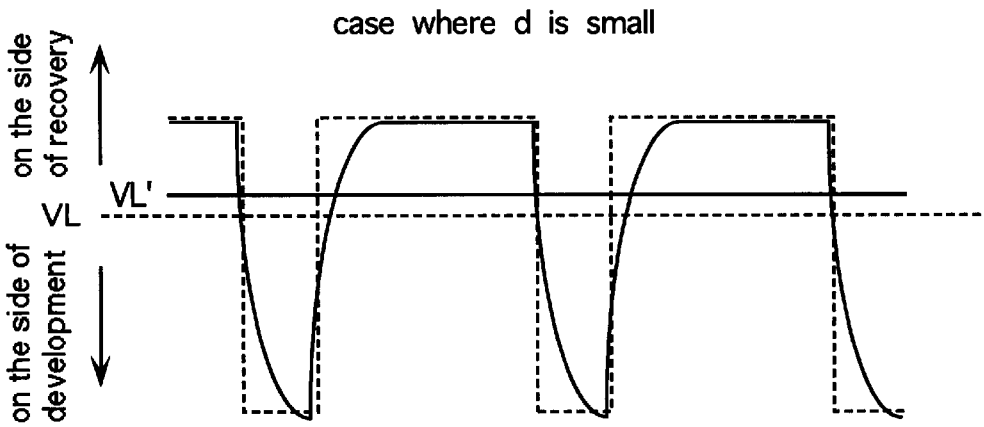
FIGS. 2(A) and 2(B) are diagrams showing a state where the waveform of an AC voltage applied to a developer carrying member and the waveform of an AC voltage actually exerted on the surface of the developer carrying member change depending on a distance at which the image carrying member and the developer carrying member are opposite to each other in the first and second developing apparatuses according to the present invention.
Figure 2:
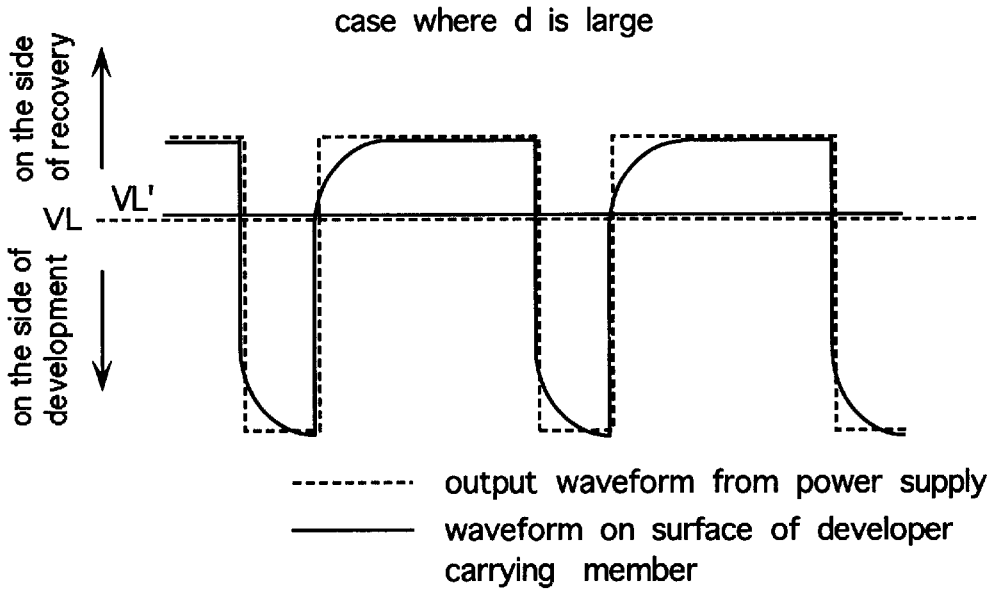

In the first and second developing apparatuses, consider a case where an AC voltage composed of a rectangular wave and including a voltage on the side of development which is exerted in the direction in which a developer is fed to an image carrying member with respect to its average voltage VL for a time period which is less than 50% of a time period during which the AC voltage, as indicated by broken lines in FIGS. 2(A) and 2(B), is exerted is applied to a developer carrying member. In this case, when the distance d at which the image carrying member and the developer carrying member are opposite to each other is small, the time constant is increased, as described above, so that the rising of a potential on the surface of the developer carrying member is long delayed. Accordingly, the waveform of the AC voltage actually exerted on the surface of the developer carrying member is indicated by a solid line in FIG. 2(A). When the rising of the potential on the surface of the developer carrying member is long delayed, as described above, the effect of the delay at a voltage on the side of development which is exerted for a short time period and is greatly changed becomes greater, as compared with that at a voltage on the side of recovery which is exerted in the direction in which the developer is returned to the developer carrying member. Therefore, the average voltage VL' of the AC voltage actually exerted on the surface of the developer carrying member is moved toward the side of recovery with respect to the average voltage VL of the AC voltage outputted from the voltage applying device S so that development is restrained. As a result, even when an AC electric field exerted between the image carrying member and the developer carrying member is strengthened because the distance d at which the image carrying member and the developer carrying member are opposite to each other is decreased, the density of an image to be formed is prevented from being increased.

On the other hand, when the distance d at which the image carrying member and the developer carrying member are opposite to each other is increased, the time constant is decreased, as described above, so that the rising of the potential on the surface of the developer carrying member is hardly delayed. Accordingly, the waveform of the AC voltage actually exerted on the surface of the developer carrying member is hardly changed from the AC voltage outputted from the voltage applying device S, as indicated by a solid line in FIG. 2(B), so that the density of the image is hardly decreased with the time constant.

In the first and second developing apparatuses according to the present invention, even when the distance d at which the image carrying member and the developer carrying member are opposite to each other varies, therefore, the density of the image to be formed is prevented from being changed. Accordingly, a good image which hardly becomes non-uniform in density and has a constant image density is stably obtained. In the first and second developing apparatuses according to the present invention, the density of the image to be formed is prevented from being made higher than a predetermined density when the distance d at which the image carrying member and the developer carrying member are opposite to each other is decreased, as described above, while being prevented from being decreased when the distance d at which the image carrying member and the developer carrying member are opposite to each other is increased, thereby decreasing the difference between the densities in both the cases. In order to obtain an image having a sufficient image density, therefore, it is preferable that some measures are taken. For example, the peak-to-peak value of the AC voltage applied to the developer carrying member is made larger, and a DC voltage applied to the developer carrying member is made higher on the side on which development is accelerated, as compared with those in normal development conditions.

In the first and second developing apparatuses, in applying the AC voltage to the developer carrying member through the resistor, and applying the AC voltage to the developer carrying member provided with the resistor layer, as described above, when the resistance values of the resistor and the resistor layer are low, the effect of the time constant is weakened, so that the density of the image to be formed cannot be sufficiently prevented from being changed. On the other hand, when the resistance values of the resistor and the resistor layer are too high, the AC electric field exerted between the developer carrying member and the image carrying member is weakened, so that an image having a sufficient image density is not obtained. Therefore, it is preferable that the resistance values of the resistor and the resistor layer are in the range of $10^3$ to $10^7$ Ω.

In a case where the AC voltage is applied to the developer carrying member through the resistor, as in the first developing apparatus, when a variable resistor is used as the resistor, a predetermined pattern is developed by the developing apparatus to detect the density thereof, and the resistance value of the variable resistor is adjusted on the basis of the result of the detection, it is possible to suitably control the change in the image density in a case where the distance d at which the image carrying member and the developer carrying member are opposite to each other varies.

In a third developing apparatus according to the present invention, in holding a developer in a developer carrying member to introduce the developer into a developing area opposite to an image carrying member at a required distance, and applying an AC voltage composed of a rectangular wave to the developer carrying member from a voltage applying device to develop an electrostatic latent image formed on the image carrying member, a resistor and a rectifier element are connected in parallel between the voltage applying device and the developer carrying member, and the rectifier element is connected in such a direction as to cut off a current caused by a voltage on the side of development, which is exerted in the direction in which the developer is fed to the image carrying member, in the AC voltage composed of the rectangular wave.

Figure 3:
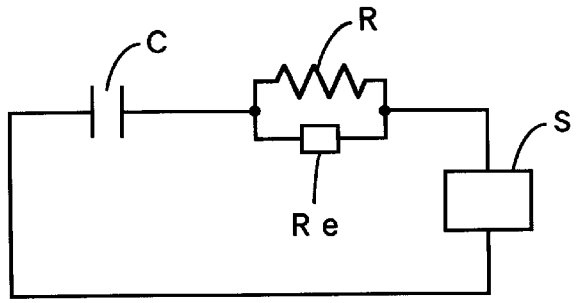
FIG. 3 is a diagram showing an equivalent circuit of a circuit which is constituted by a developing apparatus and an image carrying member in a third developing apparatus according to the present invention.

A case where in applying the AC voltage composed of the rectangular wave to the developer carrying member provided opposite to the image carrying member at a required distance from the voltage applying device, the resistor and the rectifier element are connected in parallel between the voltage applying device and the developer carrying member, and the rectifier element is connected in such a direction as to cut off the current caused by the voltage on the side of development, which is exerted in the direction in which the developer is fed to the image carrying member, in the AC voltage composed of the rectangular wave, as in the third developing apparatus according to the present invention, is represented as a circuit in which a resistor element R and a rectifier element Re which is connected in the above-mentioned direction are connected in parallel between a capacitor element C comprising an image carrying member and a developer carrying member which are opposite to each other at a required distance and a voltage applying device S, as shown in FIG. 3.

Figure 4:
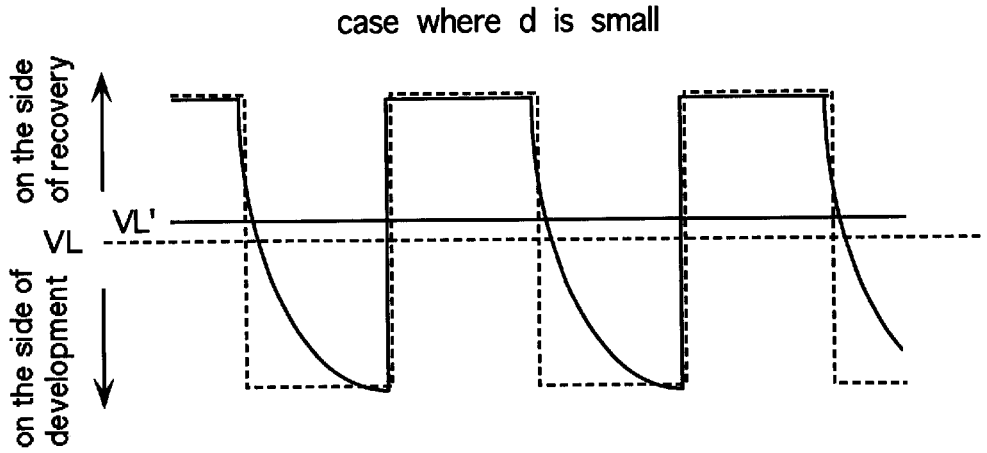
FIGS. 4(A) and 4(B) are diagrams showing a state where the waveform of an AC voltage applied to a developer carrying member and the waveform of an AC voltage actually exerted on the surface of the developer carrying member change depending on a distance at which the image carrying member and the developer carrying member are opposite to each other in the third developing apparatus according to the present invention.
Figure 4:
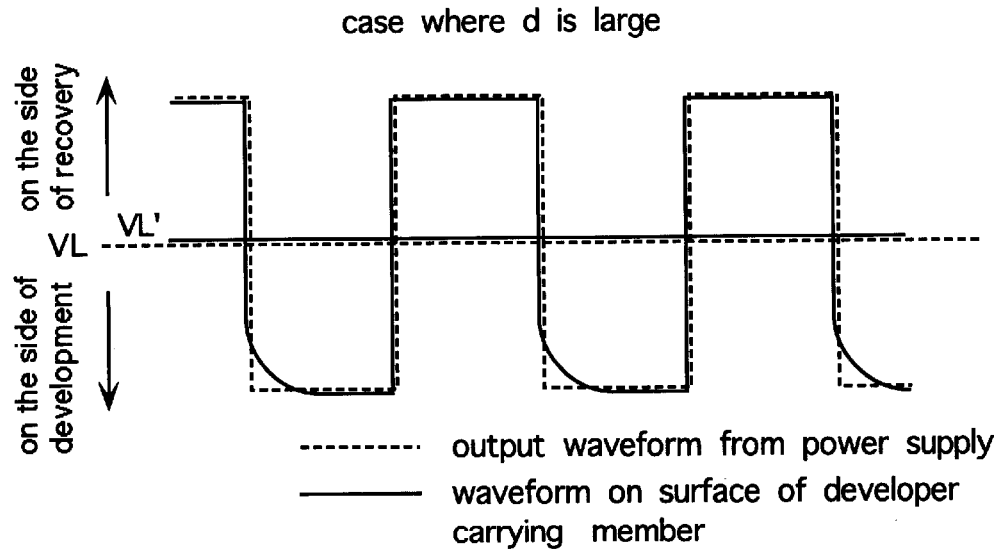

In such a circuit, when an AC voltage composed of a rectangular wave, as indicated by broken lines in FIGS. 4(A) and 4(B), is outputted from the voltage applying device S, a current flows through the resistor element R with respect to a voltage on the side of development, which is exerted in the direction in which the developer is fed to the image carrying member, in the AC voltage, so that the resistor element R and the capacitor element C are connected in series. Accordingly, a potential on the surface of the developer carrying member rises with a time constant. On the other hand, in a case where the waveform of the AC voltage is changed from the voltage on the side of development to a voltage on the side of recovery which is exerted in the direction in which the developer is returned to the developer carrying member, a current flows through the rectifier element Re. Accordingly, the potential on the surface of the developing carrying member is not affected by the time constant.

When the distance d at which the image carrying member and the developer carrying member are opposite to each other is decreased, the capacitance of the capacitor element C is increased so that the time constant is increased. On the surface of the developer carrying member, the rising of the voltage on the side of development which is exerted in the direction in which the developer is fed to the image carrying member is long delayed. On the other hand, the voltage on the side of recovery which is exerted in the direction in which the developer is returned to the developer carrying member immediately rises. Accordingly, the waveform of the AC voltage actually exerted on the surface of the developer carrying member is indicated by a solid line in FIG. 4(A). Therefore, the average voltage VL' of the AC voltage actually exerted on the surface of the developer carrying member is moved toward the side of recovery with respect to the average voltage VL of the AC voltage outputted from the voltage applying device S, so that development is restrained. As a result, even when the distance d at which the image carrying member and the developer carrying member are opposite to each other is decreased so that an AC electric field exerted between the image carrying member and the developer carrying member is strengthened, the density of an image to be formed is prevented from being increased.

On the other hand, when the distance d at which the image carrying member and the developer carrying member are opposite to each other is increased, the capacitance of the capacitor element C is decreased so that the time constant is decreased. On the surface of the developer carrying member, the rising of the voltage on the side of development which is exerted in the direction in which the developer is fed to the image carrying member is hardly delayed. Accordingly, the waveform of the AC voltage actually exerted on the surface of the developer carrying member is hardly changed from that of the AC voltage outputted from the voltage applying device S, as indicated by a solid line in FIG. 4(B). Therefore, the density of an image to be formed is hardly decreased by the effect of the time constant.

As a result, in the third developing apparatus according to the present invention, even when the distance d at which the image carrying member and the developer carrying member are opposite to each other varies, the density of the image to be formed is prevented from being changed, thereby stably obtaining a good image which hardly becomes non-uniform in density and has a constant image density. Also in the third developing apparatus, the density of the image to be formed is prevented from being made higher than a predetermined density when the distance d at which the image carrying member and the developer carrying member are opposite to each other is decreased, as described above, while being prevented from being decreased when the distance d at which the image carrying member and the developer carrying member are opposite to each other is increased, thereby decreasing the difference between the densities in both the cases. In order to obtain an image having a sufficient image density, therefore, it is preferable that some measures are taken. For example, the peak-to-peak value of the AC voltage applied to the developer carrying member is made larger, and a DC voltage applied to the developer carrying member is made higher on the side on which development is accelerated, as compared with those in normal development conditions.

Also in the third developing apparatus, when the resistance value of the resistor provided between the voltage applying device and the developer carrying member is low, as in the above-mentioned first developing apparatus, the above-mentioned effect of the time constant is weakened. When the distance d at which the image carrying member and the developer carrying member are opposite to each other varies, the density of the image to be formed cannot be sufficiently prevented from being changed. On the other hand, when the resistance value is too high, the AC electric field exerted between the developer carrying member and the image carrying member is weakened, so that an image having a sufficient image density is not obtained. Therefore, it is preferable that the resistance value of the resistor is in the range of $10^3$ to $10^7$ Ω.

As in the third developing apparatus, in providing the resistor and the rectifier element in parallel between the voltage applying device and the developer carrying member, when a variable resistor is used as the resistor, a predetermined pattern is developed by the developing apparatus to detect the density thereof, and the resistance value of the variable resistor is adjusted on the basis of the result of the detection, it is possible to more suitably control the change in the image density in a case where the distance d at which the image carrying member and the developer carrying member are opposite to each other varies.

In a fourth developing apparatus according to the present invention, in holding a developer in a developer carrying member to introduce the developer into a developing area opposite to an image carrying member at a required distance, and applying an AC voltage to the developer carrying member from a voltage applying device to develop an electrostatic latent image formed on the image carrying member, an AC voltage composed of a rectangular wave and having a constant voltage period during which there is no voltage change while the waveform of the AC voltage is changed from the peak value of a voltage on the side of recovery which is exerted in the direction in which the developer is returned to the developer carrying member to the peak value of a voltage on the side of development which is exerted in the direction in which the developer is fed to the image carrying member is applied to the developer carrying member from the voltage applying device through a resistor.

In a fifth developing apparatus according to the present invention, in holding a developer in a developer carrying member to introduce the developer into a developing area opposite to an image carrying member at a required distance, and applying an AC voltage to the developer carrying member from a voltage applying device to develop an electrostatic latent image formed on the image carrying member, the developer carrying member is provided with a resistor layer, and an AC voltage composed of a rectangular wave and having a constant voltage period during which there is no voltage change while the waveform of the AC voltage is changed from the peak value of a voltage on the side of recovery which is exerted in the direction in which the developer is returned to the developer carrying member to the peak value of a voltage on the side of development which is exerted in the direction in which the developer is fed to the image carrying member is applied to the developer carrying member provided with the resistor layer from the voltage applying device.

A case where the AC voltage is applied to the developer carrying member provided opposite to the image carrying member at a required distance through the resistor and a case where the developer carrying member is provided with a resistor layer, as in the fourth and fifth developing apparatuses, are represented as a circuit in which a resistor element R and a capacitor element C comprising an image carrying member and a developer carrying member which are opposite to each other at a required distance are connected in series to a voltage applying device S, as shown in FIG. 1.

When an AC voltage composed of a rectangular wave is applied from the voltage applying device S in such a case, a potential on the surface of the developer carrying member rises with a time constant. When a distance d at which the image carrying member and the developer carrying member are opposite to each other is decreased, the capacitance of the capacitor element C is increased so that the time constant is increased. On the other hand, when the distance d at which the image carrying member and the developer carrying member are opposite to each other is increased, the capacitance of the capacitor element C is decreased so that the time constant is decreased.

Figure 5:
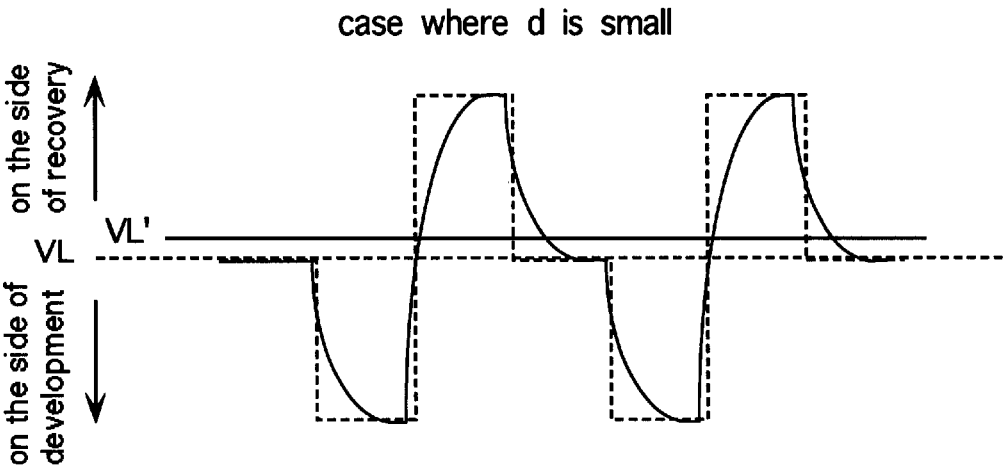
FIGS. 5(A) and 5(B) are diagrams showing a state where the waveform of an AC voltage applied to a developer carrying member and the waveform of an AC voltage actually exerted on the surface of the developer carrying member change depending on a distance at which the image carrying member and the developer carrying member are opposite to each other in the fourth and fifth developing apparatuses according to the present invention.
Figure 5:
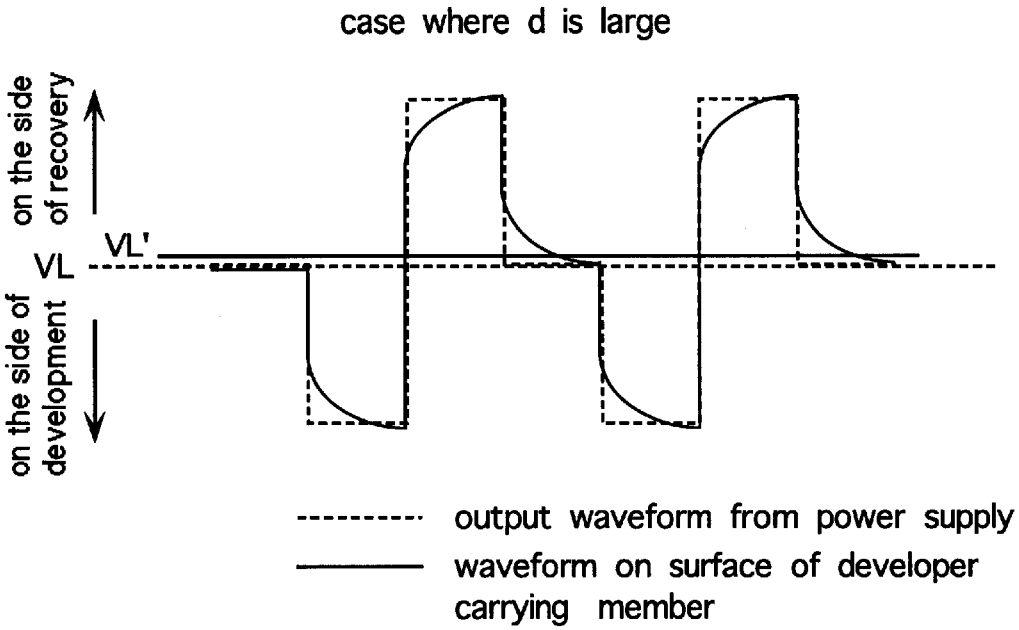

As in the fourth and fifth developing apparatuses, consider a case where an AC voltage composed of a rectangular wave as indicated by broken lines in FIGS. 5(A) and 5(B) and having a constant voltage period during which there is no voltage change while the waveform of the AC voltage is changed from the peak value of a voltage on the side of recovery which is exerted in the direction in which the developer is returned to the developer carrying member to the peak value of a voltage on the side of development which is exerted in the direction in which the developer is fed to the image carrying member is applied to the developer carrying member. In this case, the rising of a potential on the surface of the developer carrying member is delayed, respectively, while the waveform of the AC voltage is changed from the peak value of the voltage on the side of recovery to the constant voltage period during which there is no voltage change, is changed from the constant voltage period to the peak value of the voltage on the side of development, and is changed from the peak value of the voltage on the side of development to the peak value of the voltage on the side of recovery. Therefore, the number of times the rising of the potential on the surface of the developer carrying member is delayed while the waveform of the AC voltage is changed from the peak value of the voltage on the side of recovery to the peak value of the voltage on the side of development is made larger than that while being changed from the peak value of the voltage on the side of development to the peak value of the voltage on the side of recovery.

Even in a case where the above-mentioned AC voltage is applied to the developer carrying member, when the distance d at which the image carrying member and the developer carrying member are opposite to each other is small, the time constant is increased, as described above. Accordingly, the rising of the potential on the surface of the developer carrying member is long delayed, respectively, when the waveform of the AC voltage actually exerted on the surface of the developer carrying member is changed from the peak value of the voltage on the side of recovery to the constant voltage period during which there is no voltage change, is changed from the constant voltage period to the peak value on the side of development, and is changed from the peak value of the voltage on the side of development to the peak value of the voltage on the side of recovery, as indicated by a solid line in FIG. 5(A).

The number of times the rising of the potential on the surface of the developer carrying member is delayed, as described above, in a case where the waveform of the AC voltage is changed from the peak value of the voltage on the side of recovery to the peak value of the voltage on the side of development is larger than that in a case where it is changed from the peak value of the voltage on the side of development to the peak value of the voltage on the side of recovery, the average voltage VL' of the Ac voltage actually exerted on the surface of the developer carrying member is moved a longer distance toward the side of recovery with respect to the average voltage VL of the AC voltage outputted from the voltage applying device S, as indicated by a solid line in FIG. 5(A), so that development is significantly restrained. When the distance d at which the image carrying member and the developer carrying member are opposite to each other is decreased, so that the AC electric field exerted between the image carrying member and the developer carrying member is strengthened, therefore, the density of the image to be formed is prevented from being increased.

On the other hand, when the distance d at which the image carrying member and the developer carrying member are opposite to each other is increased, the time constant is decreased, as described above, so that the rising of a potential on the surface of the developing carrying member is hardly delayed. Accordingly, there is little difference between the waveform of the AC voltage actually exerted on the surface of the developer carrying member and the waveform of the AC voltage outputted from the voltage applying device S, as indicated by a solid line in FIG. 5(B). The average voltage VL' of the AC voltage actually exerted on the surface of the developer carrying member is hardly changed from the average voltage VL of the AC voltage outputted from the voltage applying device S, so that the density of the image to be formed is prevented from being decreased.

In the above-mentioned fourth and fifth developing apparatuses, even when the distance d at which the image carrying member and the developer carrying member are opposite to each other varies, therefore, the density of the image to be formed is prevented from being changed. Accordingly, a good image which hardly becomes non-uniform in density and has a constant image density is stably obtained.

Even in the fourth and fifth developing apparatuses, the density of the image to be formed is prevented from being made higher than a predetermined density when the distance d at which the image carrying member and the developer carrying member are opposite to each other is decreased, while being prevented from being decreased when the distance d at which the image carrying member and the developer carrying member are opposite to each other is large, as described above, thereby decreasing the difference between the densities in both the cases. In order to obtain an image having a sufficient image density, therefore, it is preferable that some measures are taken. For example, the peak-to-peak value of the AC voltage applied to the developer carrying member is made larger, and a DC voltage applied to the developer carrying member is made higher on the side on which development is accelerated, as compared with those in normal development conditions.

Also in the fourth and fifth developing apparatuses, the effect of the time constant is weakened, so that the density of the image to be formed cannot be sufficiently prevented from being changed when the resistance values of the resistor and the resistor layer are low, while the AC electric field exerted between the developer carrying member and the image carrying member is weakened when the resistance values are too high, so that an image having a sufficient image density is not obtained, as in the above-mentioned first and second developing apparatuses. Therefore, it is preferable that the resistance values of the resistor and the resistor layer are in the range of $10^3$ to $10^7\Omega$.

Also in the above-mentioned fourth developing apparatus, when a variable resistor is used as the resistor, a predetermined pattern is developed by the developing apparatus to detect the density thereof, and the resistance value of the variable resistor is adjusted on the basis of the result of the detection, as in the first developing apparatus, it is possible to more suitably control the change in the image density in a case where the distance d at which the image carrying member and the developer carrying member are opposite to each other varies.

In a sixth developing apparatus according to the present invention, in holding a developer in a developer carrying member to introduce the developer into a developing area opposite to an image carrying member at a required distance, and applying an AC voltage composed of a rectangular wave to the developer carrying member from a voltage applying device to develop an electrostatic latent image formed on the image carrying member, a capacitor, a resistor and a rectifier element are connected in parallel between the voltage applying device and the developer carrying member, and the rectifier element is connected in the direction in which a current caused by a voltage on the side of development, which is exerted in such a direction as to cut off the developer is fed to the image carrying member, in the AC voltage composed of the rectangular wave.

Figure 6:
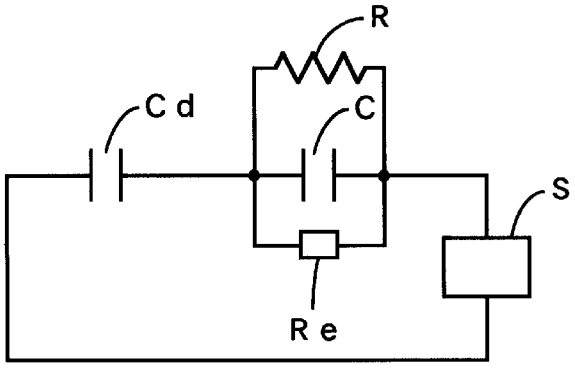
FIG. 6 is a diagram showing an equivalent circuit of a circuit which is constituted by a developing apparatus and an image carrying member in a sixth developing apparatus according to the present invention.

A case where in applying the AC voltage composed of the rectangular wave to the developer carrying member opposite to the image carrying member at a required distance from the voltage applying device, the capacitor, the resistor and the rectifier element are connected in parallel between the voltage applying device and the developer carrying member, and the rectifier element is connected in the direction in which the current caused by the voltage on the side of development, for feeding the developer to the image carrying member, in the AC voltage composed of the rectangular wave, as in the sixth developing apparatus, is represented as a circuit in which a capacitor element C, a resistor element R, and a rectifier element Re which is connected in the above-mentioned direction are connected in parallel between a capacitor element Cd comprising an image carrying member and a developer carrying member which are opposite to each other at a required distance and a voltage applying device S, as shown in FIG. 6.

Figure 7:
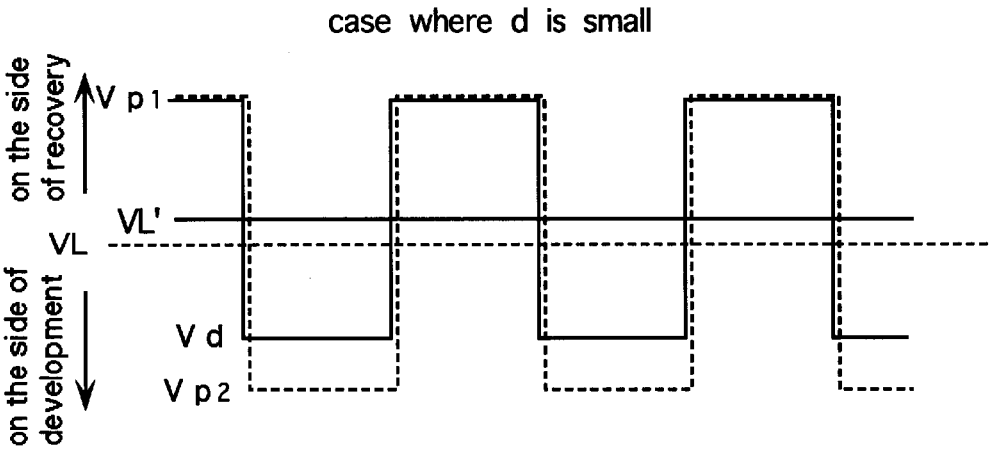
FIGS. 7(A) and 7(B) are diagrams showing a state where the waveform of an AC voltage applied to a developer carrying member and the waveform of an AC voltage actually exerted on the surface of the developer carrying member change depending on a distance at which the image carrying member and the developer carrying member are opposite to each other in the sixth developing apparatus according to the present invention.
Figure 7:
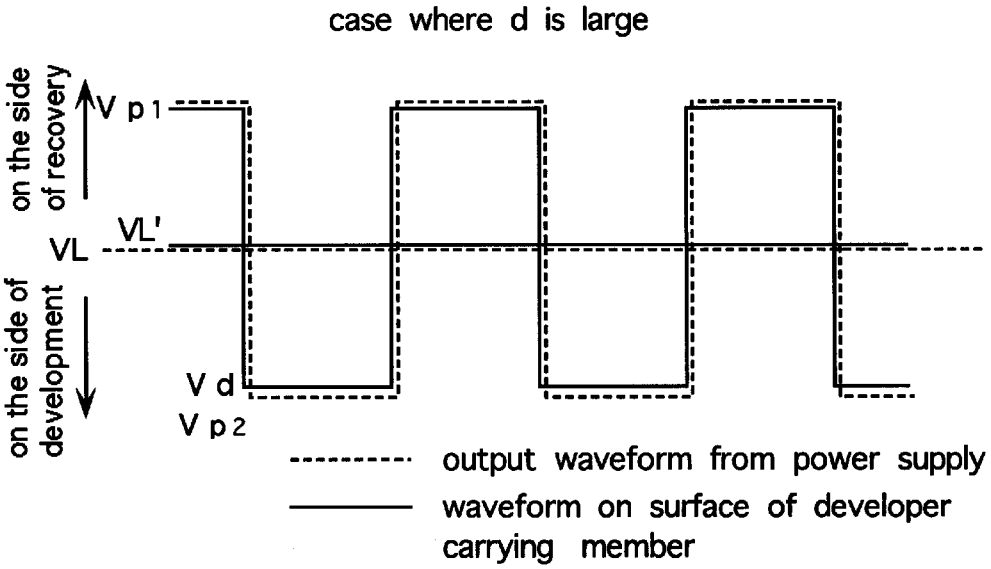

In such a circuit, consider a case where an AC voltage composed of a rectangular wave, as indicated by broken lines in FIGS. 7(A) and 7(B), is outputted from the voltage applying device S. In this case, when a voltage on the side of recovery, for returning the developer to the developer carrying member, in the AC voltage, is exerted, a current flows through the rectifier element Re because the rectifier element Re is connected in such a direction as to cut off a current caused by the voltage on the side of development, for feeding the developer to the image carrying member, in the AC voltage. Consequently, a voltage Vd applied to both ends of the capacitor element Cd is equal to a voltage peak value Vp1 on the side of recovery which is outputted from the voltage applying device S.

On the other hand, when the voltage on the side of development for feeding the developer to the developer carrying member is exerted, the voltage Vd applied to both ends of the capacitor element Cd is expressed by the following equation (1) from a voltage peak value Vp2 on the side of development which is outputted from the voltage applying device S, the capacitance $C_1$ of the capacitor element Cd comprising the image carrying member and the developer carrying member, and the capacitance $C_2$ of the capacitor element C:

$$Vd=Vp2\times C_2/(C_1+C_2) \quad (1)$$

When a distance d at which the image carrying member and the developer carrying member are opposite to each other is decreased, the value of the capacitance $C_1$ of the capacitor element Cd is increased. Accordingly, the voltage Vd applied to both ends of the capacitor element Cd is smaller than the voltage peak value Vp2 on the side of development which is outputted from the voltage applying device S, as indicated by a solid line in FIG. 7(A). Therefore, the average voltage VL' of the AC voltage actually exerted on the surface of the developer carrying member is moved toward the side of recovery with respect to the average voltage VL of the AC voltage outputted from the voltage applying device S, so that development is restrained. Even when the distance d at which the image carrying member and the developer carrying member are opposite to each other is decreased so that an AC electric field exerted between the image carrying member and the developer carrying member is strengthened, therefore, the density of an image to be formed is prevented from being increased.

On the other hand, when the distance d at which the image carrying member and the developer carrying member are opposite to each other is widened, the value of the capacitance $C_1$ of the capacitor element Cd is decreased. Consequently, the difference between the voltage Vd applied to both ends of the capacitor element Cd and the voltage peak value Vp2 on the side of development which is outputted from the voltage applying device S is decreased, as indicated by a solid line in FIG. 7(B). Therefore, the average voltage VL' of the AC voltage actually exerted on the surface of the developer carrying member is hardly changed from the average voltage VL of the AC voltage outputted from the voltage applying device S. Consequently, the density of the image to be formed is hardly decreased.

In the sixth developing apparatus, even when the distance at which the image carrying member and the developer carrying member are opposite to each other varies, therefore, the density of the image to be formed is prevented from being changed. Accordingly, a good image which hardly becomes non-uniform in density and has a constant image density is obtained. Also in the sixth developing apparatus, the density of the image to be formed is prevented from being made higher than a predetermined density when the distance d at which the image carrying member and the developer carrying member are opposite to each other is decreased, while the decrease in the density of the image to be formed is reduced when the distance d at which the image carrying member and the developer carrying member are opposite to each other is increased, as described above, thereby decreasing the difference between the densities in both the cases. In order to obtain an image having a sufficient image density, therefore, it is preferable that some measures are taken. For example, the peak-to-peak value of the AC voltage applied to the developer carrying member is made larger, and a DC voltage applied to the developer carrying member is made higher on the side on which development is accelerated, as compared with those in normal development conditions.

In a seventh developing apparatus according to the present invention, in holding a developer in a developer carrying member to introduce the developer into a developing area opposite to an image carrying member at a required distance, and applying an AC voltage to the developer carrying member from a voltage applying device to develop an electrostatic latent image formed on the image carrying member, a pulse-shaped AC voltage in which at least a voltage on the side of development which is exerted in the direction in which the developer is fed to the image carrying member is continuously or gradually decreased from its peak value is applied to the developer carrying member from the voltage applying device through a resistor.

In an eighth developing apparatus according to the present invention, in holding a developer in a developer carrying member to introduce the developer into a developing area opposite to an image carrying member at a required distance, and applying an AC voltage to the developer carrying member from a voltage applying device to develop an electrostatic latent image formed on the image carrying member, the developer carrying member is provided with a resistor layer, and a pulse-shaped AC voltage in which at least a voltage on the side of development which is exerted in the direction in which the developer is fed to the image carrying member is continuously or gradually decreased from its peak value is applied to the developer carrying member thus provided with the resistor layer from the voltage applying device.

A case where the AC voltage is applied to the developer carrying member provided opposite to the image carrying member at a required distance from the voltage applying device through the resistor and a case where the developer carrying member for applying the AC voltage is provided with the resistor layer, as in the seventh and eighth developing apparatuses, are represented as a circuit in which a resistor element R and a capacitor element C comprising an image carrying member and a developer carrying member which are opposite to each other at a required distance are connected in series to a voltage applying device S, as shown in FIG. 1, as in the above-mentioned first and second developing apparatuses.

Figure 8:
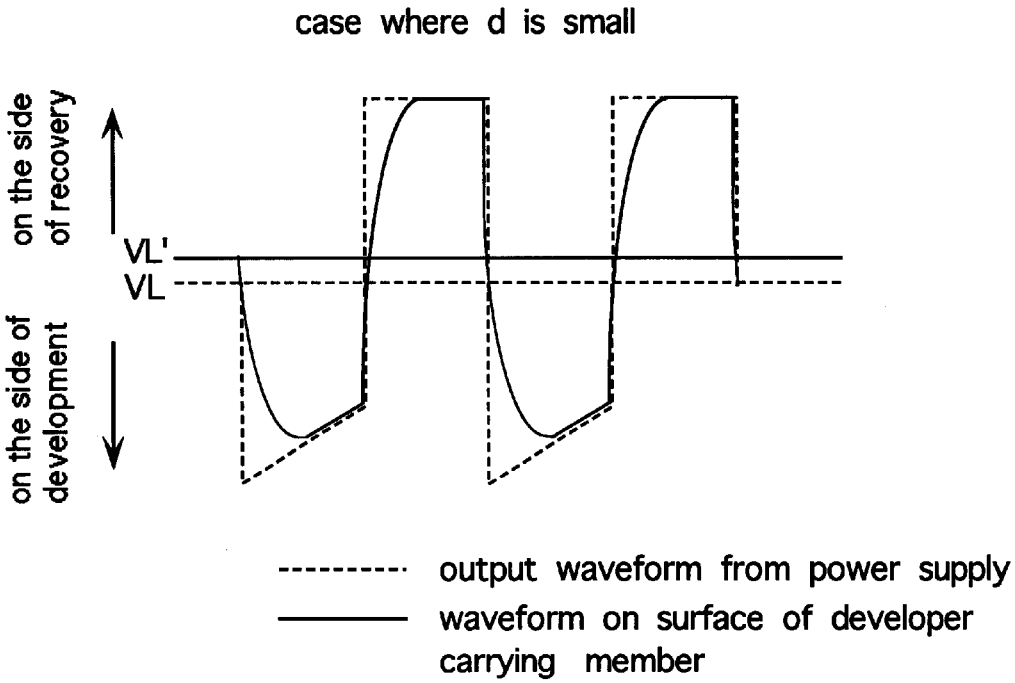
FIGS. 8(A) and 8(B) are diagrams showing a state where in a case where a pulse-shaped AC voltage in which a voltage in the direction of development which is exerted in the direction in which a developer is fed to an image carrying member is continuously decreased from its peak value, while a voltage in the direction of recovery which is exerted in the direction in which the developer is returned to a developer carrying member is composed of a rectangular wave is applied to the developer carrying member from a voltage applying device in the seventh and eighth developing apparatuses according to the present invention, the waveform of the AC voltage outputted from the voltage applying device and the waveform of the AC voltage actually exerted on the surface of the developer carrying member change depending on a distance at which the image carrying member and the developer carrying member are opposite to each other.
Figure 8:
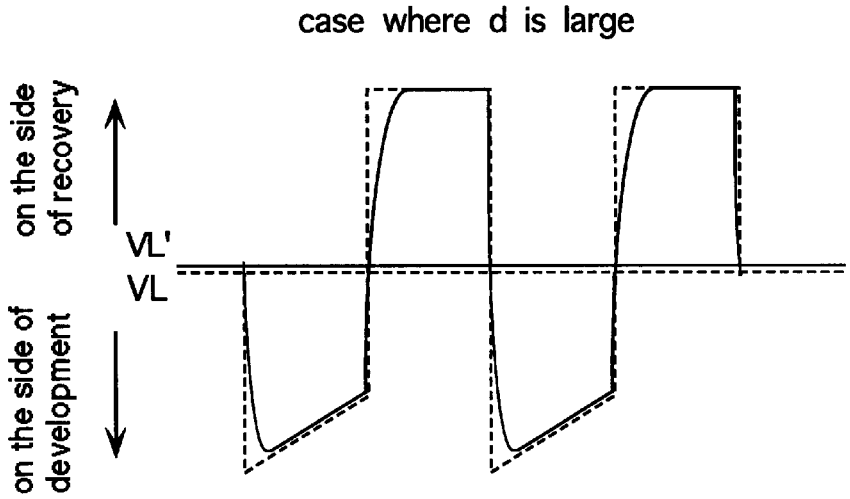

In such a circuit, when a pulse-shaped AC voltage in which a voltage on the side of development which is exerted in the direction in which the developer is fed to the image carrying member is gradually decreased from its peak value, while a voltage on the side of recovery which is exerted in the direction in which the developer is returned to the developer carrying member is composed of a rectangular wave, as indicated by broken lines in FIGS. 8(A) and 8(B) is applied to the developer carrying member from the voltage applying device S, a current on the surface of the developer carrying member rises with a time constant.

When a distance d at which the image carrying member and the developer carrying member are opposite to each other is decreased, the capacitance of the capacitor element C is increased so that the time constant is increased. Accordingly, the rising of a potential on the surface of the developer carrying member is long delayed, as indicated by a solid line in FIG. 8(A). Particularly, the voltage on the side of development which is exerted in the direction in which the developer is fed to the image carrying member is continuously decreased from its peak value. Accordingly, the potential on the surface of the developer carrying member is decreased in a state where it does not reach its peak value. The average voltage VL' of the AC voltage actually exerted on the surface of the developer carrying member is moved a longer distance toward the side of recovery with respect to the average voltage VL of the AC voltage outputted from the voltage applying device S, so that development is significantly restrained. Even when the distance d at which the image carrying member and the developer carrying member are opposite to each other is decreased so that a AC electric field exerted between the image carrying member and the developer carrying member is strengthened, therefore, the density of an image to be formed is prevented from being increased.

On the other hand, when the distance d at which the image carrying member and the developer carrying member are opposite to each other is increased, the capacitance of the capacitor element C is decreased so that the time constant is decreased. Accordingly, the rising of a potential on the surface of the developer carrying member is hardly delayed. Consequently, the difference between the waveform of the AC voltage actually exerted on the surface of the developer carrying member and the waveform of the AC voltage outputted from the voltage applying device S is decreased, as indicated by a solid line in FIG. 8(B). Accordingly, the average voltage VL' of the AC voltage actually exerted on the surface of the developer carrying member is prevented from being moved toward the side of recovery with respect to the average voltage VL of the AC voltage outputted from the voltage applying device S. Therefore, the density of the image to be formed is prevented from being decreased.

As a result, in the above-mentioned seventh and eighth developing apparatuses, when an AC voltage as indicated by broken lines in FIGS. 8(A) and 8(B), is applied to the developer carrying member, the density of the image to be formed is prevented from being changed even when the distance d at which the image carrying member and the developer carrying member are opposite to each other varies. Accordingly, a good image which hardly becomes non-uniform in density and has a constant image density is stably obtained.

Figure 9:
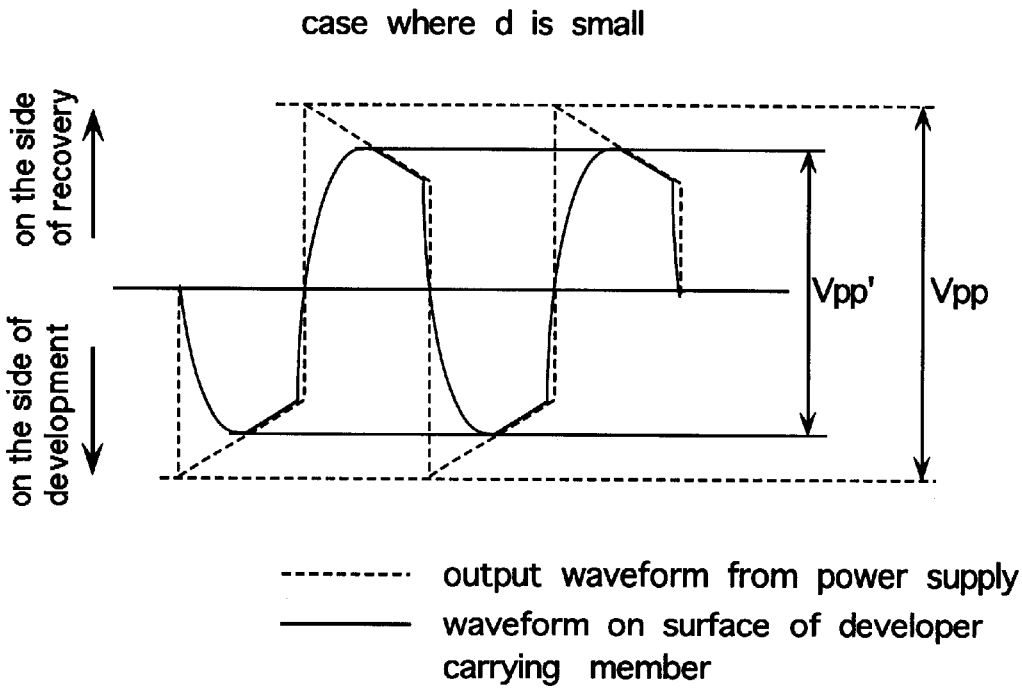
FIGS. 9(A) and 9(B) are diagrams showing a state where in a case where a pulse-shaped AC voltage in which a voltage in the direction of development which is exerted in the direction in which a developer is fed to an image carrying member and a voltage in the direction of recovery which is exerted in the direction in which the developer is returned to a developer carrying member are continuously decreased from their respective peak values is applied to the developer carrying member from a voltage applying device in the seventh and eighth developing apparatuses according to the present invention, the waveform of the AC voltage outputted from the voltage applying device and the waveform of the AC voltage actually exerted on the surface of the developer carrying member change depending on a distance at which an image carrying member and the developer carrying member are opposite to each other.
Figure 9:
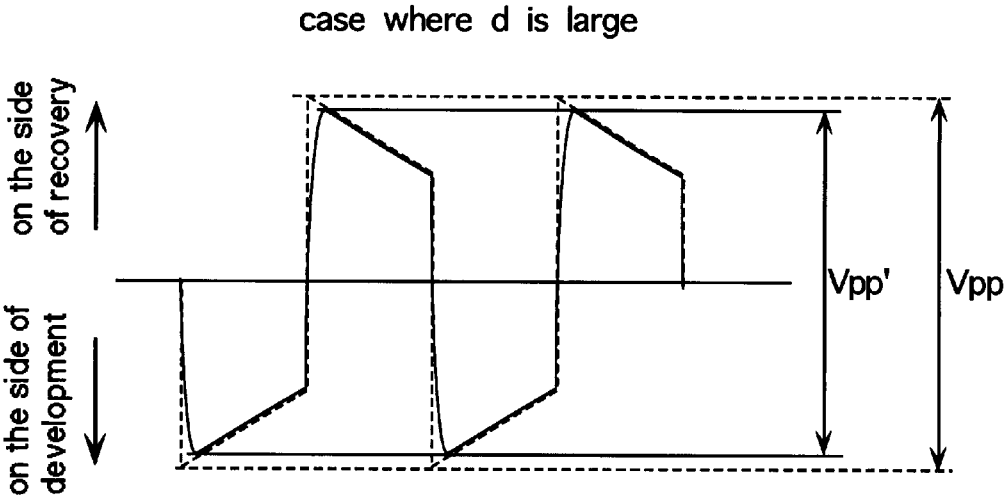

In the above-mentioned seventh and eighth developing apparatuses, even when a pulse-shaped AC voltage in which a voltage on the side of development which is exerted in the direction in which the developer is fed to the image carrying member and a voltage on the side of recovery which is exerted in the direction in which the developer is returned to the developer carrying member are continuously or gradually decreased from their respective peak values is applied to the developer carrying member, as indicated by broken lines in FIGS. 9(A) and 9(B), from the voltage applying device S, a potential on the surface of the developer carrying member rises with a time constant, as in the above-mentioned case.

When the distance d at which the image carrying member and the developer carrying member are opposite to each other is decreased, the time constant is increased, as described above. Accordingly, the rising of the waveform of the AC voltage actually exerted on the surface of the developer carrying member is long delayed, as indicated by a solid line in FIG. 9(A), so that the voltage on the side of development and the voltage on the side of recovery start to be decreased at low potentials before reaching their respective peak values. Therefore, the peak-to-peak value Vpp' of the AC voltage actually exerted on the surface of the developer carrying member is decreased more greatly, as compared with the peak-to-peak value Vpp of the AC voltage outputted from the voltage applying device S. Even when the distance d at which the image carrying member and the developer carrying member are opposite to each other is decreased, therefore, an AC electric field exerted between the image carrying member and the developer carrying member is prevented from being strengthened. Accordingly, the density of the image to be formed is prevented from being increased.

On the other hand, when the distance d at which the image carrying member and the developer carrying member are opposite to each other is increased, the time constant is decreased, as described above. Accordingly, the waveform of the AC voltage actually exerted on the surface of the developer carrying member is indicated by a solid line in FIG. 9(B). Therefore, the peak-to-peak value Vpp' of the AC voltage actually exerted on the surface of the developer carrying member is decreased more slightly, as compared with the peak-to-peak value Vpp of the AC voltage outputted from the voltage applying device S. Accordingly, the density of the image to be formed is prevented from being decreased.

As a result, in the above-mentioned seventh and eighth developing apparatuses, even when the AC voltage, as indicated by the broken lines in FIGS. 9(A) and 9(B), is applied to the developer carrying member, the density of the image to be formed is prevented from being changed when the distance d at which the image carrying member and the developer carrying member are opposite to each other varies. Accordingly, a good image which hardly becomes non-uniform in density and has a constant image density is stably obtained.

In the above-mentioned seventh and eighth developing apparatuses, when a time period during which the voltage on the side of development, which is exerted in the direction in which the developer is fed to the image carrying member, in the above-mentioned AC voltage is less than 50% of a time period during which the AC voltage is exerted, the effect of the delay in the rising of the potential on the surface of the developer carrying member at the voltage on the side of development which is exerted for a short time period and is greatly changed is larger than that at the voltage on the side of recovery which is exerted in the direction in which the developer is returned to the developer carrying member.

When the distance d at which the image carrying member and the developer carrying member are opposite to each other is decreased, so that the rising of the potential on the surface of the developer carrying member is long delayed, the average voltage VL' of the AC voltage actually exerted on the surface of the developer carrying member is moved a longer distance toward the side of recovery with respect to the average voltage VL of the AC voltage outputted from the voltage applying device S, so that development is significantly restrained. On the other hand, when the distance d at which the image carrying member and the developer carrying member are opposite to each other is increased, the effect of the delay is decreased. Even when the distance d at which the image carrying member and the developer carrying member are opposite to each other varies, the density of the image to be formed is prevented from being changed. Accordingly, a good image which hardly becomes non-uniform in density and has a constant image density is stably obtained.

In the above-mentioned seventh developing apparatus, consider a case where a rectifier element is connected in parallel with the resistor between the voltage applying device and the developer carrying member, and a current caused by the voltage on the side of development, which is exerted in the direction in which the developer is fed to the image carrying member, in the AC voltage is cut off by the rectifier element. In this case, in the case of the voltage on the side of development which is exerted in the direction in which the developer is fed to the image carrying member, the voltage actually exerted on the surface of the developer carrying member is affected by the time constant, as described above, so that the rising thereof is delayed. On the other hand, in the case of the voltage on the side of recovery which is exerted in the direction in which the developer is returned to the developer carrying member, the current flows through the rectifier element so that the voltage is not affected by the time constant. When the distance d at which the image carrying member and the developer carrying member are opposite to each other is decreased, so that the rising of the potential on the side of development on the surface of the developer carrying member is long delayed, therefore, the average voltage VL' of the AC voltage actually exerted on the surface of the developer carrying member is moved a longer distance toward the side of recovery with respect to the average voltage VL of the AC voltage outputted from the voltage applying device S, so that development is significantly restrained. On the other hand, when the distance d at which the image carrying member and the developer carrying member are opposite to each other varies, the effect of the delay is decreased. When the distance d at which the image carrying member and the developer carrying member are opposite to each other varies, therefore, the density of the image to be formed is further prevented from being changed. Accordingly, a good image which hardly becomes non-uniform in density and has a constant image density is stably obtained.

Also in the above-mentioned seventh and eighth developing apparatuses, the development is restrained, to prevent the density of the image to be formed from being increased when the distance d at which the image carrying member and the developer carrying member are opposite to each other is decreased, while the decrease in the density of the image is reduced when the distance d at which the image carrying member and the developer carrying member are opposite to each other is increased, as described above, thereby decreasing the difference between the densities in both the cases. In order to obtain an image having a sufficient image density, therefore, it is preferable that some measures are taken. For example, the peak-to-peak value of the AC voltage applied to the developer carrying member is made larger, and a DC voltage applied to the developer carrying member is made higher on the side on which development is accelerated, as compared with those in normal development characteristics.

Also in the seventh and eighth developing apparatuses, when the resistance values of the resistor and the resistor layer are low, as in the above-mentioned first and second developing apparatuses, the effect of the time constant is weakened, so that the density of the image to be formed cannot be sufficiently prevented from being changed. On the other hand, when the resistance values are too high, the AC electric field exerted between the developer carrying member and the image carrying member is weakened, so that an image having a sufficient image density is not obtained. Therefore, it is preferable that the resistance values of the resistor and the resistor layer are in the range of $10^3$ to $10^7\Omega$.

Also in the eighth developing apparatus, a variable resistor is used as the resistor, and a predetermined pattern is developed by the developing apparatus to detect the density thereof, as in the above-mentioned first developing apparatus. When the resistance value of the variable resistor is adjusted on the basis of the result of the detection, it is possible to suitably control the change in the image density in a case where the distance d at which the image carrying member and the developer carrying member are opposite to each other varies.

Developing apparatuses according to embodiments of the present invention will be specifically described on the basis of accompanying drawings.

(Embodiment 1)

Figure 10:
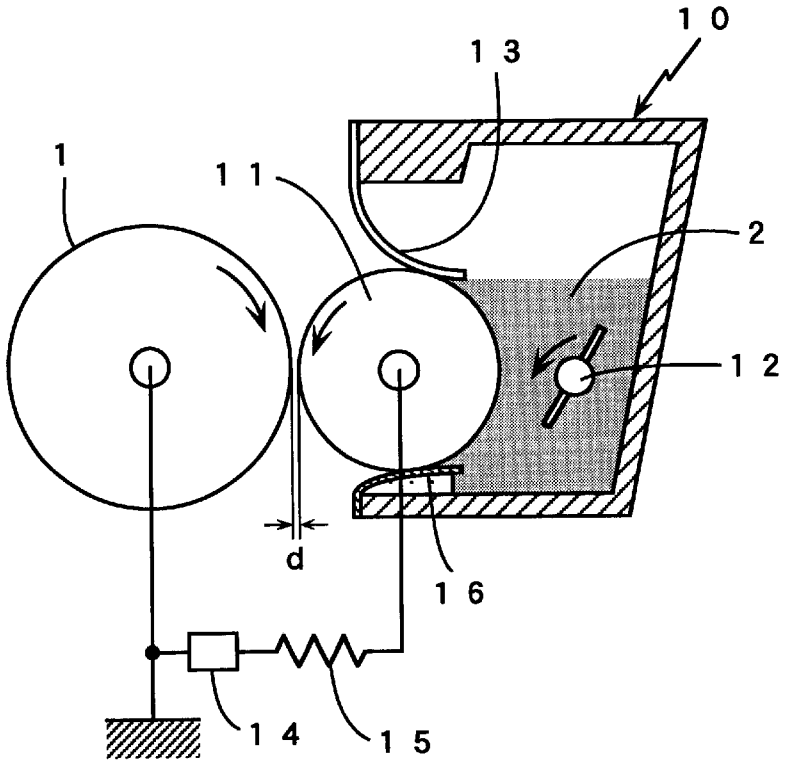
FIG. 10 is a schematic illustration of a developing apparatus according to an embodiment 1 in which a resistor is provided between a voltage applying device and a developer carrying member.

In a developing apparatus according to an embodiment 1, a developer carrying member 11 in a roller shape is provided such that it is opposite to an image carrying member 1 at a required distance d, to supply toners 2 contained in an apparatus body 10 to the developer carrying member 11 by a supplying member 12, as shown in FIG. 10.

The developer carrying member 11 is rotated, to convey the toners 2 supplied in the above-mentioned manner, and a regulating member 13 is pressed against the surface of the developer carrying member 11, to regulate the amount of the toners 2 to be conveyed as well as to subject the toners 2 to triboelectric charging. The toners 2 thus charged are introduced into a developing area opposite to the image carrying member 1 at the required distance d by the developer carrying member 11.

An example of the developer carrying member 11 is a metal roller having a ten-point average roughness Rz of approximately 7 $\mu$m obtained by subjecting its surface to blast processing. Further, an example of the regulating member 13 is a plate material composed of stainless or phosphor bronze having a thickness of 0.08 mm to 0.2 mm.

In the developing apparatus according to the embodiment 1, there is provided a resistor 15 having a resistance value in the range of $10^3$ to $10^7\Omega$ between the developer carrying member 11 and a voltage applying device 14. A developing bias voltage obtained by overlapping a DC voltage with an AC voltage composed of a rectangular wave and including a voltage on the side of development which is exerted in the direction in which the toners 2 are fed to the image carrying member 1 with respect to its average voltage VL for a time period which is less than 50% of a time period during which the AC voltage is exerted is outputted, as indicted by broken lines shown in FIGS. 2(A) and 2(B), from the voltage applying device 14. The developing bias voltage is applied to the developer carrying member 11 through the resistor 15. Therefore, the toners 2 held in the developer carrying member 11 are supplied to an electrostatic latent image formed on the image carrying member 1, to perform development.

After development is thus performed, the toners 2 after the development are introduced into the apparatus body 10 by the developer carrying member 11, and the toners 2 are removed from the developer carrying member 11 by a removing member 16 and are returned to the apparatus body 10.

Figure 11:
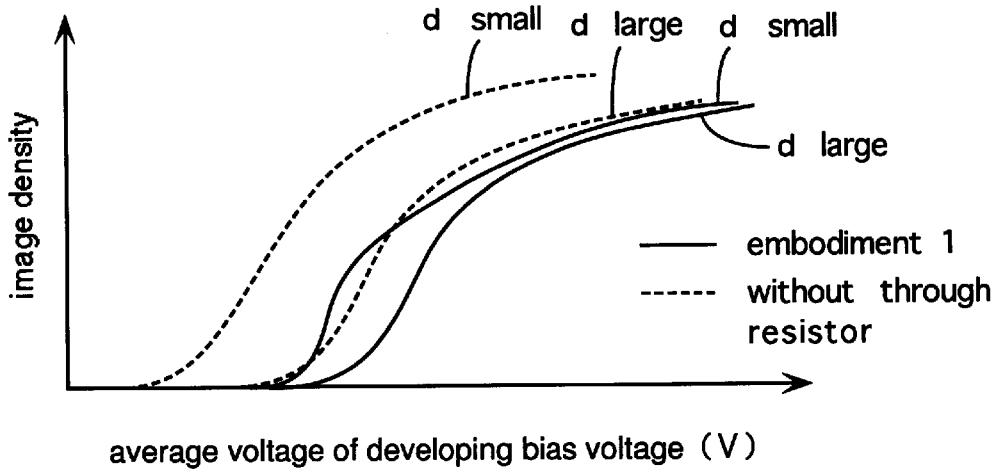
FIG. 11 is a diagram showing the results of comparison between changes in developing characteristics in a case where a distance at which an image carrying member and a developer carrying member are opposite to each other is large and a case where it is small in the developing apparatus according to the embodiment 1 and a developing apparatus so adapted that a developing bias voltage is directly applied to a developer carrying member from a voltage applying device.

In a case where the above-mentioned developing bias voltage is applied to the developer carrying member 11 through the resistor 15 to perform development, as in the developing apparatus according to the embodiment 1, and a case where the developing bias voltage is directly applied to the developer carrying member 11 without through the resistor 15, the voltage value of the DC voltage applied from the voltage applying device 14 is changed, to change the average voltage of the developing bias voltage. Developing characteristics in a case where the distance d at which the image carrying member 1 and the developer carrying member 11 are opposite to each other is large and a case where it is small are examined. The results thereof are shown in FIG. 11. In FIG. 11, the developing characteristics in the case where the developing bias voltage is applied to the developer carrying member 11 through the resistor 15 to perform development as in the developing apparatus according to the embodiment 1 are indicated by a solid line, and the developing characteristics in the case where the developing bias voltage is directly applied to the developer carrying member 11 without through the resistor 15 to perform development are indicated by a broken line.

As a result, when the developing bias voltage is applied to the developer carrying member 11 through the resistor 15 to perform development, as in the developing apparatus according to the embodiment 1, the difference between image densities in a case where the distance d at which the image carrying member 1 and the developer carrying member 11 are opposite to each other is large and a case where it is small is made smaller, as compared with that in the case where the developing bias voltage is directly applied to the developer carrying member 11 without through the resistor 15. The image density in a case where the distance d at which the image carrying member 1 and the developer carrying member 11 are opposite to each other varies is prevented from being changed, thereby obtaining a good image which hardly becomes non-uniform in density and has a stable image density.

Figure 12:
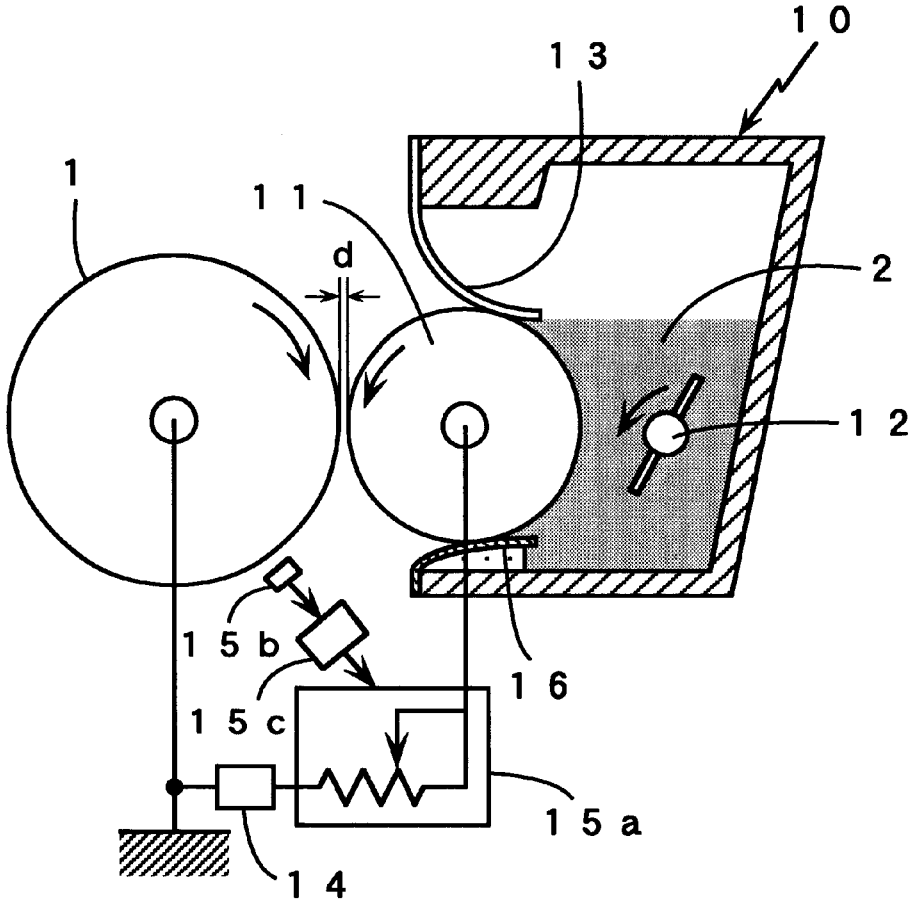
FIG. 12 is a schematic illustration of a modified example of the developing apparatus according to the embodiment 1, that is, a developing apparatus in which a variable resistor is provided between a voltage applying device and a developer carrying member.

Although in the developing apparatus according to the embodiment 1, the resistor 15 having a resistance value in the range of $10^3$ to $10^7\Omega$ is provided between the developer carrying member 11 and the voltage applying device 14 for supplying the developing bias voltage, there may be provided a variable resistor 15*a* whose resistance value can be varied between the developer carrying member 11 and the voltage applying device 14 and a sensor 15*b* for detecting the toner density of a toner image formed on the developer carrying member 11, as in a developing apparatus shown in FIG. 12, thereby making it possible to change the resistance value of the variable resistor 15*a* by a control device 15*c* on the basis of the toner density measured by the sensor 15*b*.

(Embodiment 2)

Figure 13:
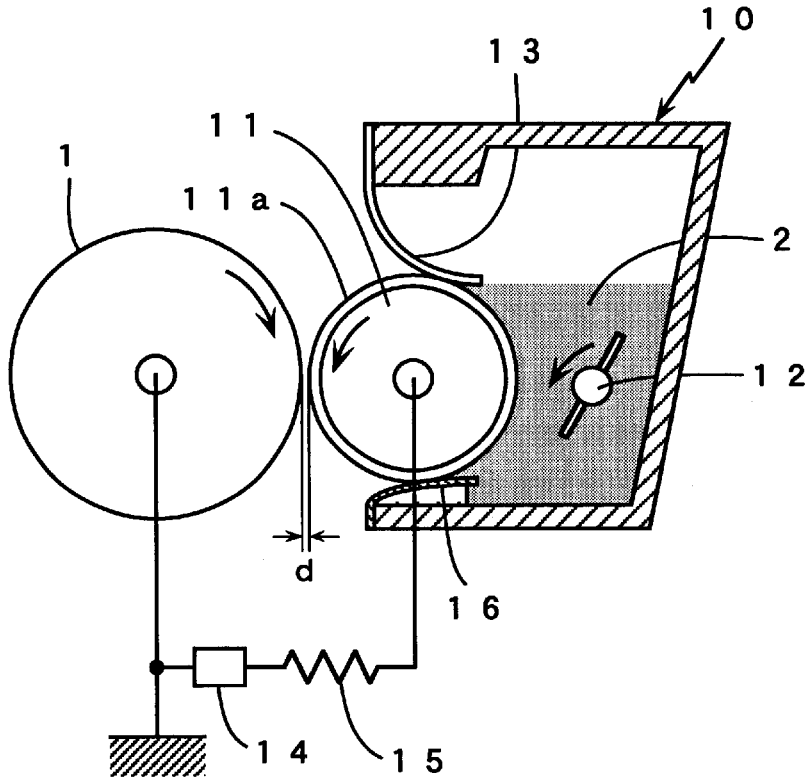
FIG. 13 is a schematic illustration of a developing apparatus according to an embodiment 2 in which a developer carrying member is provided with a resistor layer.

A developing apparatus according to an embodiment 2 is almost similar in construction to the developing apparatus according to the embodiment 1 shown in FIG. 10 except that a resistor layer 11*a* having a resistance value in the range of $10^3$ to $10^7\Omega$ is provided on the surface of a developer carrying member 11 instead of providing a resistor 15 between the developer carrying member 11 and a voltage applying device 14 for supplying a developing bias voltage, as shown in FIG. 13.

The developing apparatus according to the embodiment 2 is the same as the developing apparatus according to the embodiment 1 except that a developing bias voltage obtained by overlapping a DC voltage with an AC voltage composed of a rectangular wave and including a voltage on the side of development which is exerted in the direction in which toners 2 are fed to an image carrying member 1 with respect to its average voltage VL for a time period which is less than 50% of a time period during which the AC voltage is exerted is applied, as indicated in broken lines in FIGS. 2(A) and 2(B), to perform development.

In the developing apparatus according to the embodiment 2, a conductive roller such as a metal roller is used as the developer carrying member 11, and a resistor layer 11*a* composed of a rubber material such as EPDM, silicon rubber, or urethane rubber, or a resin material such as polystyrene, polyolefin, polyurethane, polyester, polyvinyl chloride, polybutadiene, or polyamide is provided on the surface of the developer carrying member 11.

When the above-mentioned developing bias voltage is applied to the developer carrying member 11 provided with the resistor layer 11*a* from the voltage applying device 14 to perform development, as in the developing apparatus according to the embodiment 2, an image density is prevented from being changed when the distance d at which the image carrying member 1 and the developer carrying member 11 are opposite to each other varies, thereby obtaining a good image which hardly becomes non-uniform in density and has a stable image density, as in the developing apparatus according to the embodiment 1.

EXAMPLES A1 AND A2 AND COMPARATIVE EXAMPLE a1

A developing apparatus in a specific example A1 according to the embodiment 1 and a developing apparatus in a specific example A2 according to the embodiment 2, and a developing apparatus in a comparative example a1 will be compared with each other, to clarify that an image density is prevented from being changed even when a distance at which an image carrying member and a developer carrying member are opposite to each other varies, thereby obtaining a good image which hardly becomes non-uniform in density in the developing apparatuses in the examples A1 and A2.

In the developing apparatus in the example A1, a resistor 15 having a resistance value of 500 kΩ is provided between the developer carrying member 11 and the voltage applying device 14 in the developing apparatus according to the embodiment 1 shown in FIG. 10. In the developing apparatus in the example A2, a resistor layer 11*a* having a resistance value of 500 kΩ is provided on the surface of the developer carrying member 11 in the developing apparatus according to the embodiment 2 shown in FIG. 13.

On the other hand, in the developing apparatus in the comparative example a1, a developer carrying member 11 which is not provided with a resistor layer 11*a* is used, and a resistor 15 is not provided between the developer carrying member 11 and the voltage applying device 14.

Figure 14:
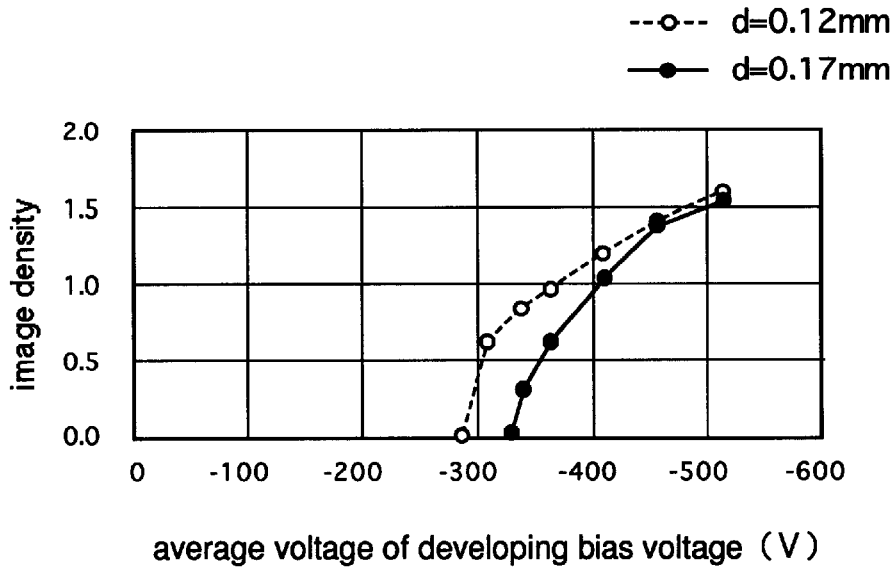
FIG. 14 is a diagram showing changes in developing characteristics in a case where a distance at which an image carrying member and a developer carrying member are opposite to each other is large and a case where it is small in a developing apparatus in a specific example A1 of the embodiment 1.
Figure 15:
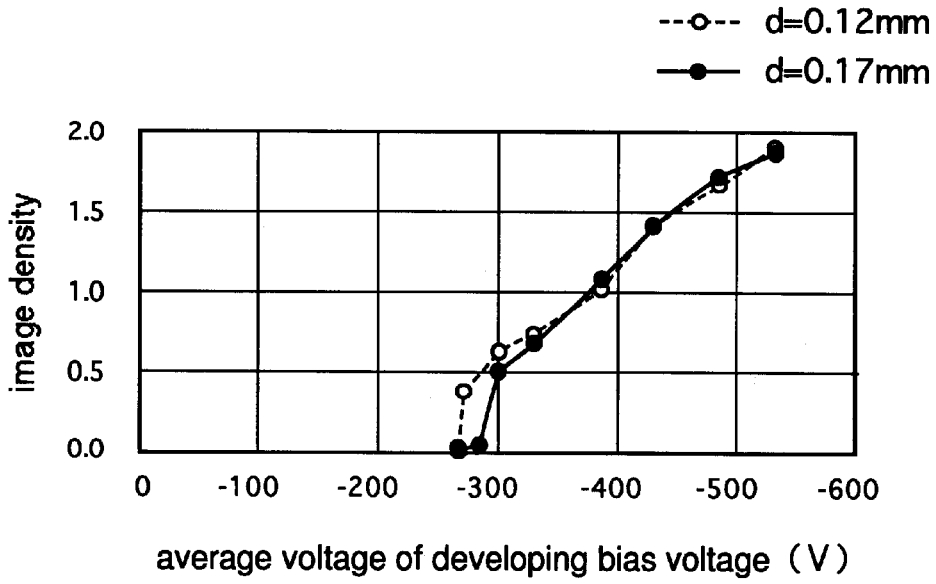
FIG. 15 is a diagram showing changes in developing characteristics in a case where a distance at which an image carrying member and a developer carrying member are opposite to each other is large and a case where it is small in a developing apparatus in a specific example A2 of the embodiment 2.
Figure 16:
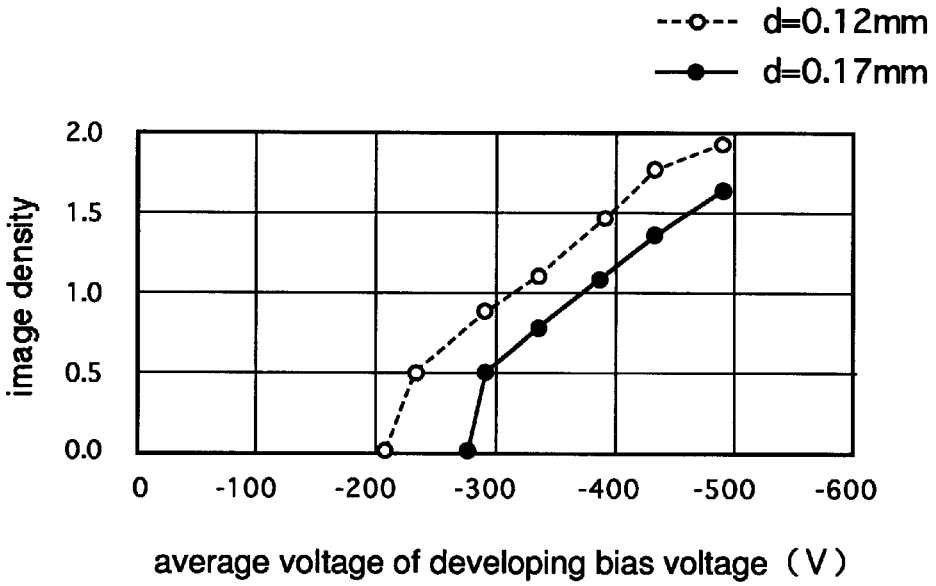
FIG. 16 is a diagram showing changes in developing characteristics in a case where a distance at which an image carrying member and a developer carrying member are opposite to each other is large and a case where it is small in a developing apparatus in a comparative example a1.

In each of the developing apparatuses in the examples A1 and A2 and the comparative example a1, an AC voltage composed of a rectangular wave having a peak-to-peak value Vpp of 1.3 kV and having a frequency of 2.6 kHz and including a voltage on the side of development which is exerted in the direction in which toners 2 are fed to an image carrying member 1 with respect to its average voltage VL for a time period which is less than 30% of a time period during which the AC voltage is exerted and a DC voltage are outputted from the voltage applying device 14, and the voltage value of the DC voltage applied from the voltage applying device 14 is changed, to change the average voltage of the developing bias voltage. Developing characteristics in a case where a distance d at which the image carrying member 1 and the developer carrying member 11 are opposite to each other is 0.12 mm and a case where it is 0.17 mm are examined. The results thereof in the developing apparatus in the example A1 are shown in FIG. 14, the results thereof in the developing apparatus in the example A2 are shown in FIG. 15, and the results thereof in the developing apparatus in the comparative example a1 are shown in FIG. 16. In FIGS. 14 to 16, the result in a case where the distance at which the image carrying member 1 and the developer carrying member 11 are opposite to each other is 0.12 mm is indicated by ○ and a broken line, and the result in a case where the distance d at which the image carrying member 1 and the developer carrying member 11 are opposite to each other is 0.17 mm is indicated by ● and a solid line.

As a result, when image densities in the case where the distance d at which the image carrying member 1 and the developer carrying member 11 are opposite to each other is 0.12 mm and the case where it is 0.17 mm are compared with each other in the vicinity of an image density of 1.5 at which an image having a sufficient density is obtained, the difference between the image densities in both the cases is large in the developing apparatus in the comparative example a1. Contrary to this, in each of the developing apparatuses in the examples A1 and A2, there is little difference between the image densities. Under conditions on which development is actually performed, even if the distance d at which the image carrying member 1 and the developer carrying member 11 are opposite to each other varies, the density of an image to be formed hardly becomes non-uniform. Accordingly, a good image having a constant image density is stably obtained.

(Embodiment 3)

Figure 17:
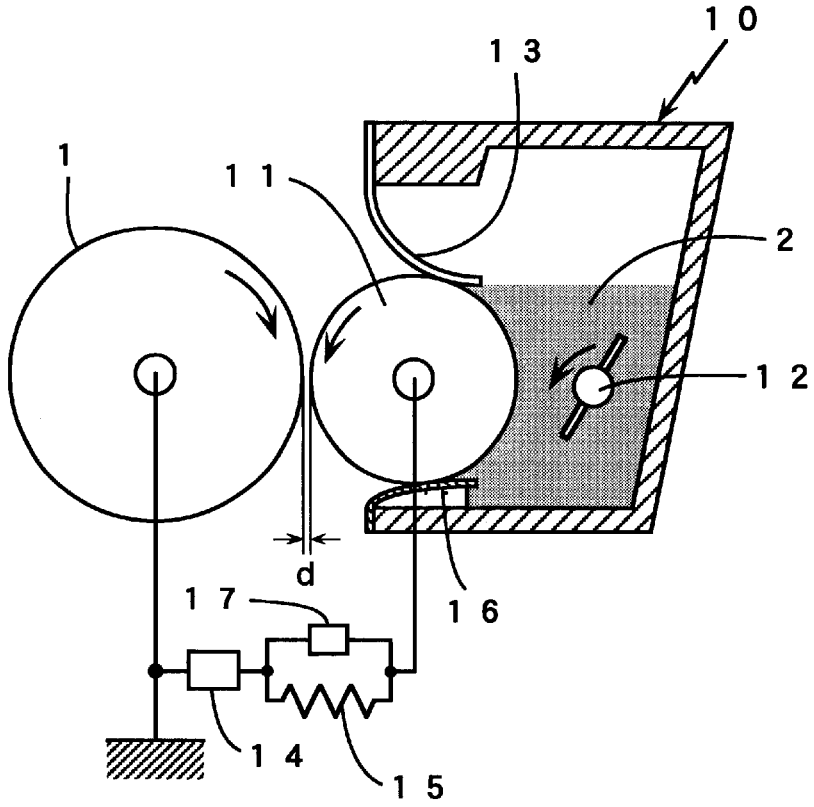
FIG. 17 is a schematic illustration of a developing apparatus according to an embodiment 3 in which a resistor and a rectifier element are connected in parallel between a voltage applying device and a developer carrying member.

Also in a developing apparatus according to an embodiment 3, a developer carrying member 11 in a roller shape is provided such that it is opposite to an image carrying member 1 at a required distance d, to supply toners 2 contained in an apparatus body 10 to the developer carrying member 11 by a supplying member 12, as in the developing apparatus according to the embodiment 1 shown in FIG. 10, as shown in FIG. 17.

The developer carrying member 11 is rotated, to convey the toners 2 supplied in the above-mentioned manner, and a regulating member 13 is pressed against the surface of the developer carrying member 11, to regulate the amount of the toners 2 to be conveyed as well as to subject the toners 2 to triboelectric charging. The toners 2 thus charged are introduced into a developing area opposite to the image carrying member 1 at the required distance d by the developer carrying member 11. The toners 2 are supplied to an electrostatic latent image formed on the image carrying member 1, to perform development. The same components as those in the developing apparatus according to the embodiment 1 are used as the developer carrying member 11 and the regulating member 13.

In the developing apparatus according to the embodiment 3, a resistor 15 having a resistance value in the range of $10^3$ to $10^7\Omega$ and a rectifier element 17 such as a diode are connected in parallel between the developer carrying member 11 and a voltage applying device 14. The rectifier element 17 is connected in such a direction as to cut off a current caused by a voltage on the side of development which is exerted in the direction in which the toners 2 are fed to the image carrying member 1.

In the developing apparatus according to the embodiment 3, a developing bias voltage obtained by overlapping a DC voltage with an AC voltage composed of a rectangular wave is outputted, as indicated by broken lines in FIGS. 3(A) and 3(B), from the voltage applying device 14. The developing bias voltage is applied to the developer carrying member 11 through the resistor 15 and the rectifier element 17 which are connected in parallel. Consequently, the toners 2 held in the developer carrying member 11 are supplied to an electrostatic latent image formed on the image carrying member 1, to perform development.

Figure 18:
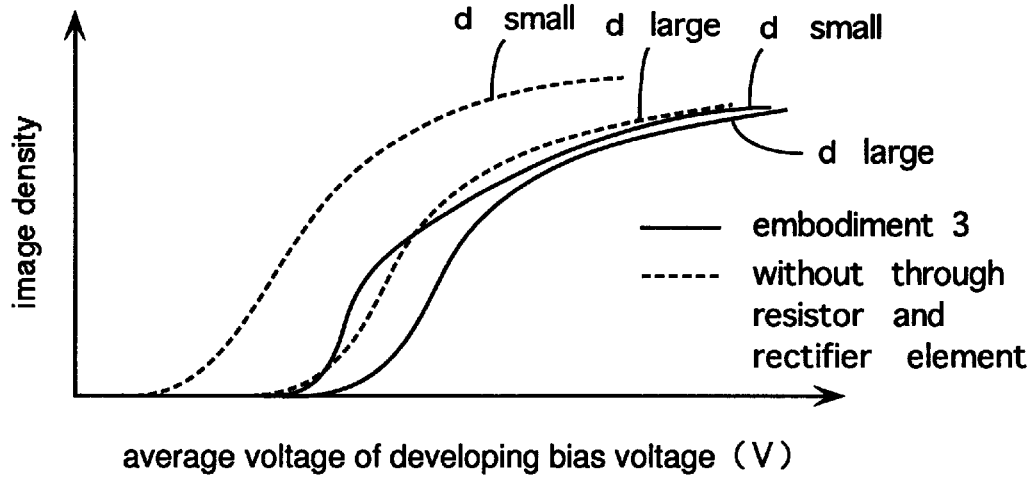
FIG. 18 is a diagram showing the results of comparison between changes in developing characteristics in a case where a distance at which an image carrying member and a developer carrying member are opposite to each other is large and a case where it is small in the developing apparatus according to the embodiment 3 and a developing apparatus so adapted that a developing bias voltage is directly applied to the developer carrying member from a voltage applying device.

In a case where the above-mentioned developing bias voltage is applied to the developer carrying member 11 through the resistor 15 and the rectifier element 17 which are connected in parallel to perform development, as in the developing apparatus according to the embodiment 3, and a case where the developing bias voltage is directly applied to the developer carrying member 11 to perform development, the voltage value of the DC voltage applied from the voltage applying device 14 is changed, to change the average voltage of the developing bias voltage. Developing characteristics in a case where the distance d at which the image carrying member 1 and the developer carrying member 11 are opposite to each other is large and a case where it is small are examined. The results thereof are shown in FIG. 18. In FIG. 18, the developing characteristics in a case where the developing bias voltage is applied to the developer carrying member 11 through the resistor 15 and the rectifier element 17 which are connected in parallel to perform development, as in the developing apparatus according to the embodiment 3, are indicated by a solid line, and the developing characteristics in the case where the developing bias voltage is directly applied to the developer carrying member 11 to perform development are indicated by a broken line.

As a result, when the developing bias voltage is applied to the developer carrying member 11 through the resistor 15 and the rectifier element 17 which are connected in parallel to perform development, as in the developing apparatus according to the embodiment 3, the difference between image densities in a case where the distance d at which the image carrying member 1 and the developer carrying member 11 are opposite to each other is large and a case where it is small is made smaller, as compared with that in a case where the developing bias voltage is directly applied to the developer carrying member 11 to perform development. The image density in a case where the distance d at which the image carrying member 1 and the developer carrying member 11 are opposite to each other varies is prevented from being changed, thereby obtaining a good image which hardly becomes non-uniform in density and has a stable image density.

Figure 19:
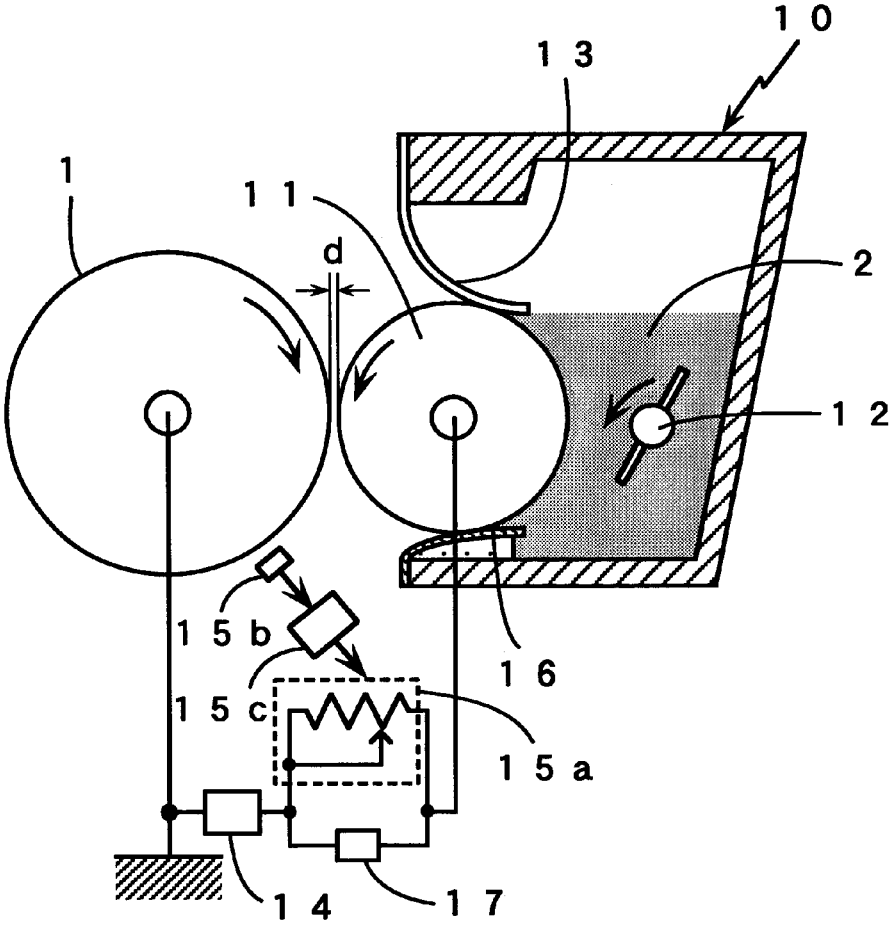
FIG. 19 is a schematic illustration of a modified example of the developing apparatus according to the embodiment 3, that is, a developing apparatus in which a variable resistor and a rectifier element are connected in parallel between a developer carrying member and a power supply.

Although in the developing apparatus according to the embodiment 3, the resistor 15 having a resistance value in the range of $10^3$ to $10^7$ Ω and the rectifier element 17 such as a diode are connected in parallel between the developer carrying member 11 and the voltage applying device 14 for supplying the developing bias voltage, a variable resistor 15*a* whose resistance value can be varied and a rectifier element 17 may be connected in parallel between the developer carrying member 11 and the voltage applying device 14, and a sensor 15*b* for detecting the toner density of a toner image formed on the developer carrying member 11 may be provided in close proximity to the developer carrying member 11, as shown in FIG. 19, thereby making it possible to change the resistance value of the variable resistor 15*a* by a control device 15*c* on the basis of the toner density measured by the sensor 15*b*.

EXAMPLE B1 AND COMPARATIVE EXAMPLE b1

A developing apparatus in a specific example B1 according to the embodiment 3 and a developing apparatus in a comparative example b1 will be compared with each other, to clarify that an image density is prevented from being changed even when a distance at which an image carrying member and a developer carrying member are opposite to each other varies, thereby obtaining a good image which hardly becomes non-uniform in density in the developing apparatus in the example B1.

In the developing apparatus in the example B1, a resistor 15 having a resistance value of 150 kΩ and a rectifier element 17 are connected in parallel between the developer carrying member 11 and the voltage applying device 14 in the developing apparatus according to the embodiment 3 shown in FIG. 17, and the rectifier element 17 cuts off a current caused by a voltage on the side of development which is exerted in the direction in which toners 2 are fed to the image carrying member 1.

On the other hand, in the developing apparatus in the comparative example b1, the voltage applying device 14 is directly connected to the developer carrying member 11 without providing a resistor 15 and a rectifier element 17 between the voltage applying device 14 and the developer carrying member 11.

In each of the developing apparatuses in the example B1 and the comparative example b1, an AC voltage composed of a rectangular wave having a peak-to-peak value Vpp of 1.3 kV and having a frequency of 2.6 kHz, together with a DC voltage, is outputted from the voltage applying device 14, and the voltage value of the DC voltage outputted from the voltage applying device 14 is changed, to change the average voltage of the developing bias voltage.

Figure 20:
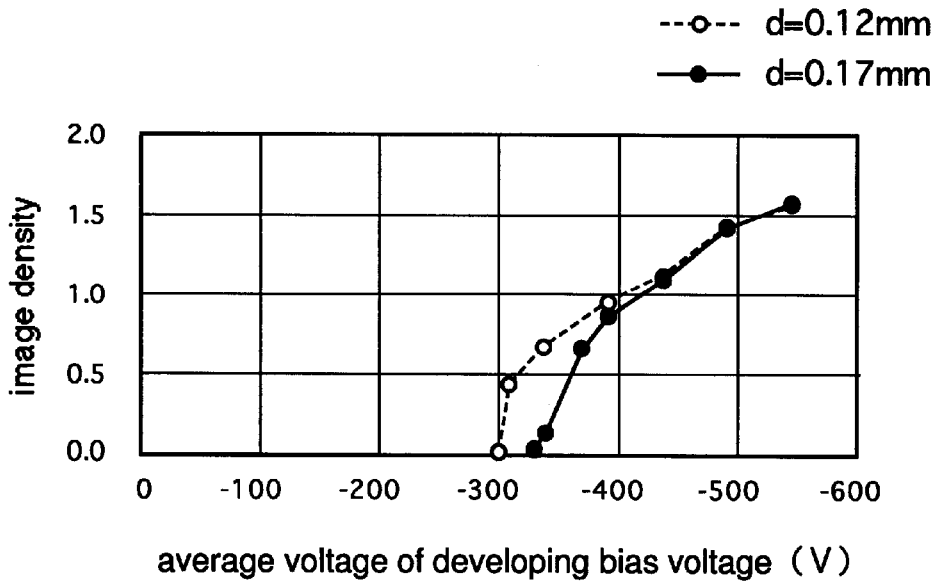
FIG. 20 is a diagram showing changes in developing characteristics in a case where a distance at which an image carrying member and a developer carrying member are opposite to each other is large and a case where it is small in a developing apparatus in a specific example B1 of the embodiment 3.
Figure 21:
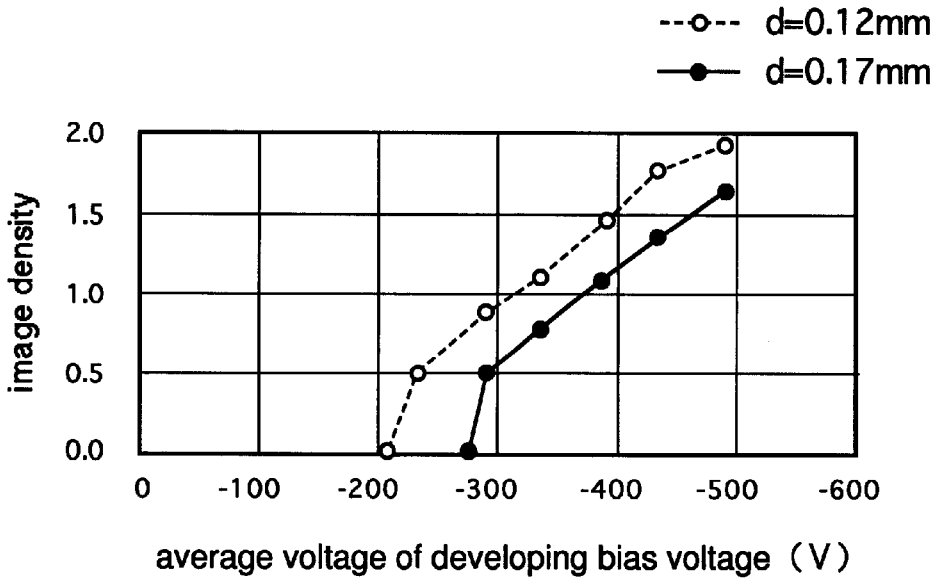
FIG. 21 is a diagram showing changes in developing characteristics in a case where a distance at which an image carrying member and a developer carrying member are opposite to each other is large and a case where it is small in a developing apparatus in a comparative example a2.

Developing characteristics in a case where the distance d at which the image carrying member 1 and the developer carrying member 11 are opposite to each other is 0.12 mm and a case where it is 0.17 mm are examined. The results thereof in a case where the developing apparatus in the example B1 is used are shown in FIG. 20, and the results thereof in a case where the developing apparatus in the comparative example b1 is used are shown in FIG. 21. In FIGS. 20 to 21, the result in a case where the distance at which the image carrying member 1 and the developer carrying member 11 are opposite to each other is 0.12 mm is indicated by ○ and a broken line, and the result in a case where the distance d at which the image carrying member 1 and the developer carrying member 11 are opposite to each other is 0.17 mm is indicated by ● and a solid line.

As a result, when image densities in the case where the distance d at which the image carrying member 1 and the developer carrying member 11 are opposite to each other is 0.12 mm and the case where it is 0.17 mm are compared with each other in the vicinity of an image density of 1.5 at which an image having a sufficient density is obtained, the difference between the image densities in both the cases is large in the developing apparatus in the comparative example b1. Contrary to this, in the developing apparatus in the example B1, there is little difference between the image densities. Under conditions on which development is actually performed, even if the distance d at which the image carrying member 1 and the developer carrying member 11 are opposite to each other varies, the density of an image to be formed hardly becomes non-uniform. Accordingly, a good image having a constant image density is stably obtained.

(Embodiment 4)

In a developing apparatus according to an embodiment 4, a developer carrying member 11 in a roller shape is provided such that it is opposite to an image carrying member 1 at a required distance d, to supply toners 2 contained in an apparatus body 10 to the developer carrying member 11 by a supplying member 12, as in the developing apparatus according to the embodiment 1 shown in FIG. 10.

The developer carrying member 11 to which the toners 2 have been supplied is rotated, to convey the toners 2, and a regulating member 13 is pressed against the surface of the developer carrying member 11, to regulate the amount of the toners 2 to be conveyed as well as to subject the toners 2 to triboelectric charging. The toners 2 thus charged are introduced into a developing area opposite to the image carrying member 1 at the required distance d. The same components as those in the developing apparatus according to the embodiment 1 are used as the developer carrying member 11 and the regulating member 13.

Also in the developing apparatus according to the embodiment 4, there is provided a resistor 15 having a resistance value in the range of $10^3$ to $10^7\Omega$ between the developer carrying member 11 and a voltage applying device 14, as in the developing apparatus according to the embodiment 1 shown in FIG. 10.

In the developing apparatus according to the embodiment 4, a developing bias voltage obtained by overlapping a DC voltage with an AC voltage composed of a rectangular wave and having a constant voltage period during which there is no voltage change while the waveform of the AC voltage is changed from the peak value of a voltage on the side of recovery which is exerted in the direction in which the toners 2 are returned to the developer carrying member 11 to the peak value of a voltage on the side of development which is exerted in the direction in which the toners 2 are fed to the image carrying member 1 is outputted, as indicated by broken lines in FIGS. 5(A) and 5(B), from the voltage applying device 14. The developing bias voltage is applied to the developer carrying member 11 through the resistor 15. Consequently, the toners 2 held in the developer carrying member 11 are supplied to an electrostatic latent image formed on the image carrying member 1, to perform development.

Figure 22:
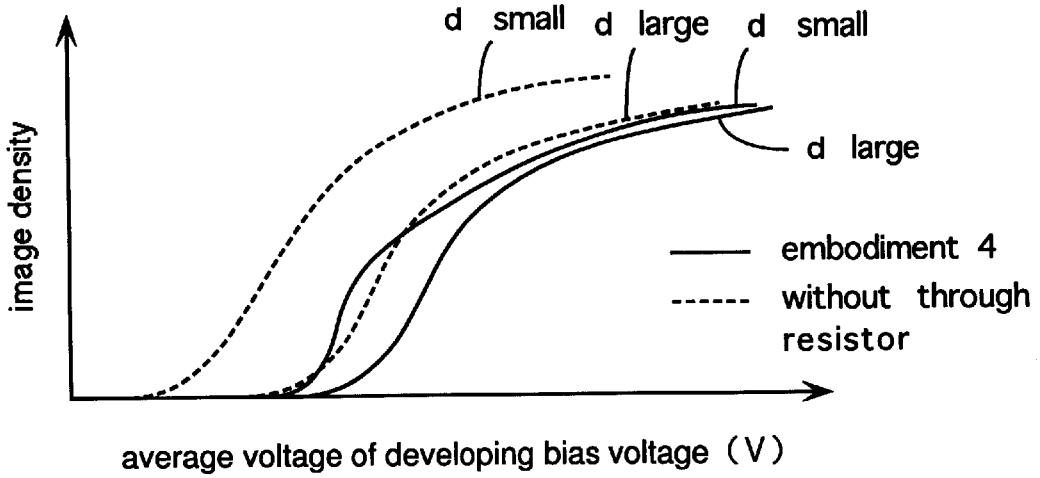
FIG. 22 is a diagram showing the results of comparison between changes in developing characteristics in a case where a distance at which an image carrying member and a developer carrying member are opposite to each other is large and a case where it is small in a developing apparatus according to an embodiment 4 in which a resistor is provided between a voltage applying device and a developer carrying member and a developing apparatus so adapted that a developing bias voltage is directly applied to a developer carrying member from a voltage applying device.

In a case where the above-mentioned developing bias voltage is applied to the developer carrying member 11 through the resistor 15 to perform development, as in the developing apparatus according to the embodiment 4, and a case where the developing bias voltage is directly applied to the developer carrying member 11 without through the resistor 15, the voltage value of the DC voltage applied from the voltage applying device 14 is changed, to change the average voltage of the developing bias voltage. Developing characteristics in a case where the distance d at which the image carrying member 1 and the developer carrying member 11 are opposite to each other is large and a case where it is small are examined. The results thereof are shown in FIG. 22. In FIG. 22, the developing characteristics in the case where the developing bias voltage is applied to the developer carrying member 11 through the resistor 15 to perform development as in the developing apparatus according to the embodiment 4 are indicated by a solid line, and the developing characteristics in the case where the developing bias voltage is directly applied to the developer carrying member 11 without through the resistor 15 to perform development are indicated by a broken line.

As a result, when the developing bias voltage is applied to the developer carrying member 11 through the resistor 15 to perform development, as in the developing apparatus according to the embodiment 4, the difference between image densities in a case where the distance d at which the image carrying member 1 and the developer carrying member 11 are opposite to each other is large and a case where it is small is made smaller, as compared with that in the case where the developing bias voltage is directly applied to the developer carrying member 11 without through the resistor 15. The image density in a case where the distance d at which the image carrying member 1 and the developer carrying member 11 are opposite to each other varies is prevented from being changed, thereby obtaining a good image which hardly becomes non-uniform in density and has a stable image density.

Although in the developing apparatus according to the embodiment 4, the resistor 15 having a resistance value in the range of $10^3$ to $10^7\Omega$ is provided between the developer carrying member 11 and the voltage applying device 14 for supplying the developing bias voltage, there may be provided a variable resistor 15*a* whose resistance value can be varied between the developer carrying member 11 and the voltage applying device 14 and a sensor 15*b* for detecting the toner density of a toner image formed on the developer carrying member 11, as shown in FIG. 12, thereby making it possible to change the resistance value of the variable resistor 15*a* by a control device 15*c* on the basis of the toner density measured by the sensor 15*b*.

(Embodiment 5)

In a developing apparatus according to an embodiment 5, a resistor layer 11*a* having a resistance value in the range of $10^3$ to $10^7\Omega$ is provided on the surface of a developer carrying member 11, as in the developing apparatus according to the embodiment 2 shown in FIG. 13, instead of providing a resistor 15 between the developer carrying member 11 and a voltage applying device 14 for supplying a developing bias voltage, as in the developing apparatus according to the embodiment 4. Used as the developer carrying member 11 is one using a conductive roller such as a metal roller and composed of a rubber material such as EPDM, silicon rubber, or urethane rubber, or a resin material such as polystyrene, polyolefin, polyurethane, polyester, polyvinyl chloride, polybutadiene, or polyamide on the surface of the developer carrying member 11, as in the developing apparatus according to the embodiment 2.

A developing bias voltage obtained by overlapping a DC voltage with an AC voltage composed of a rectangular wave and having a constant voltage period during which there is no voltage change while the waveform of the AC voltage is changed from the peak value of a voltage on the side of recovery which is exerted in the direction in which toners 2 are returned to the developer carrying member 11 to the peak value of a voltage on the side of development which is exerted in the direction in which the toners 2 are fed to the image carrying member 1 is applied to perform development, as indicated by broken lines in FIGS. 5(A) and 5(B), as in the developing apparatus according to the embodiment 4, from the voltage applying device 14 to the developer carrying member 11 thus provided with the resistor layer 11*a*.

When the above-mentioned developing bias voltage is applied to the developer carrying member 11 provided with the resistor layer 11*a* from the voltage applying device 14 to perform development, as in the developing apparatus according to the embodiment 5, an image density in a case where a distance d at which the image carrying member 1 and the developer carrying member 11 are opposite to each other varies is prevented from being changed, thereby obtaining a good image which hardly becomes non-uniform in density and has a stable image density, as in the developing apparatus according to the embodiment 4.

EXAMPLES C1 AND C2 AND COMPARATIVE EXAMPLE c1

A developing apparatus in a specific example C1 according to the embodiment 4 and a developing apparatus in a specific example C2 according to the embodiment 5, and a developing apparatus in a comparative example c1 will be compared with each other, to clarify that an image density is prevented from being changed even when a distance at which an image carrying member and a developer carrying member are opposite to each other varies, thereby obtaining a good image which hardly becomes non-uniform in density in the developing apparatuses in the examples C1 and C2.

In the developing apparatus in the example C1, a resistor 15 having a resistance value of 500 kΩ is provided between the developer carrying member 11 and the voltage applying device 14 in the developing apparatus shown in FIG. 10. Further, in the developing apparatus in the example C2, a resistor layer 11*a* having a resistance value 1.5 MΩ is formed on the surface of the developer carrying member 11 in the developing apparatus shown in FIG. 13.

On the other hand, in the developing apparatus in the comparative example c1, a developer carrying member 11 which is not provided with a resistor layer 11*a* is used, and a resistor 15 is not provided between the developer carrying member 11 and the voltage applying device 14.

In each of the developing apparatuses in the example C1 and C2, an AC voltage composed of a rectangular wave having a peak-to-peak value Vpp of 1.3 kV and having a frequency of 1.3 kHz, including a voltage on the side of development which is exerted in the direction in which toners 2 are fed to an image carrying member 1 for a time period of 155 μs and a voltage on the side of recovery which is exerted in the direction in which the toners 2 are returned to the developer carrying member 11 for a time period of 270 μs, and having a constant voltage period of 385 μm during which there is no voltage change while the waveform of the AC voltage is changed from the peak value of the voltage on the side of recovery which is exerted in the direction in which the toners 2 are returned to the developer carrying member 11 to the peak value of the voltage on the side of development which is exerted in the direction in which the toners 2 are fed to the image carrying member 1, together with a DC voltage, is outputted from the voltage applying device 14.

On the other hand, in the developing apparatus in the comparative example c1, an AC voltage composed of a rectangular wave having a peak-to-peak value Vpp of 1.3 kV and having a frequency of 2.6 kHz and including a voltage which is exerted in the direction in which the toners 2 are fed to the image carrying member 1 for a time period which is 30% of a time period during which the AC voltage is exerted, together with a DC voltage, is outputted from the voltage applying device 14.

Figure 23:
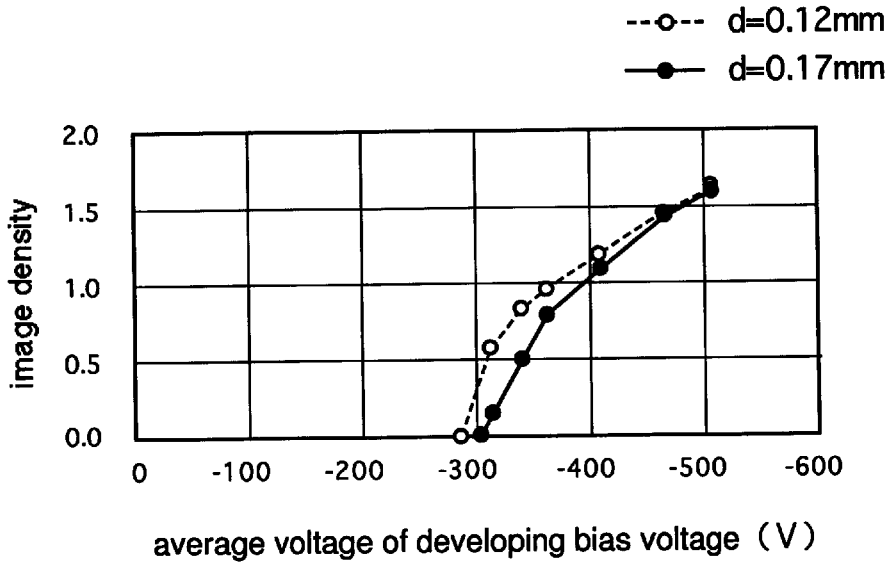
FIG. 23 is a diagram showing changes in developing characteristics in a case where a distance at which an image carrying member and a developer carrying member are opposite to each other is large and a case where it is small in a developing apparatus in a specific example C1 of the embodiment 4.
Figure 24:
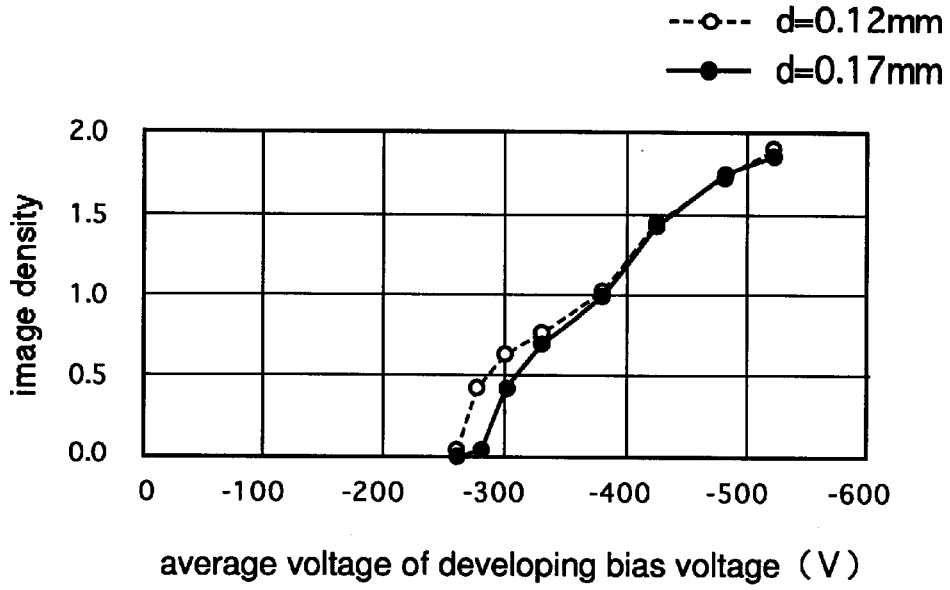
FIG. 24 is a diagram showing changes in developing characteristics in a case where a distance at which an image carrying member and a developer carrying member are opposite to each other is large and a case where it is small in a developing apparatus in a specific example C2 of an embodiment 5.
Figure 25:
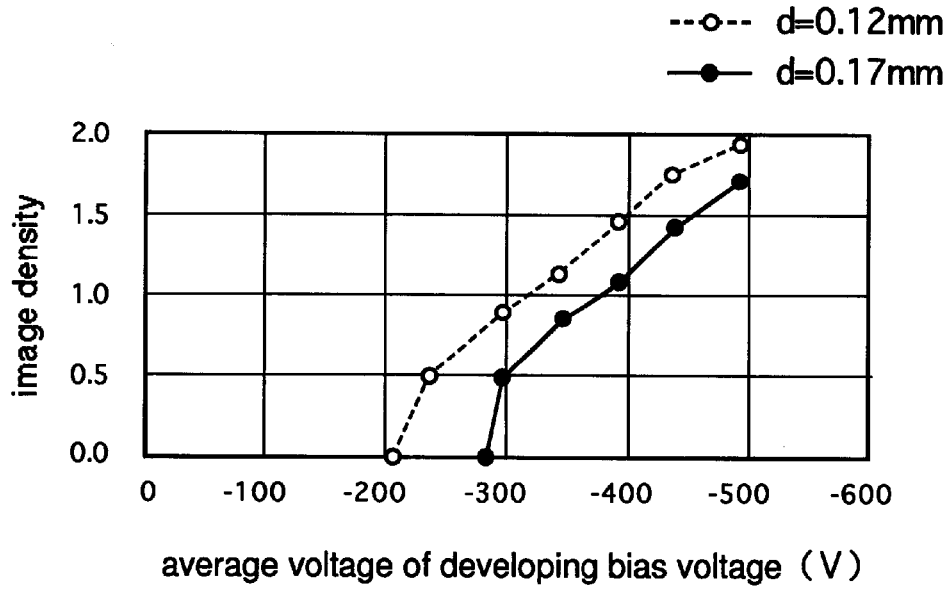
FIG. 25 is a diagram showing changes in developing characteristics in a case where a distance at which an image carrying member and a developer carrying member are opposite to each other is large and a case where it is small in a developing apparatus in a comparative example c1.

In each of the developing apparatuses in the examples C1 and C2 and the comparative example c1, the voltage value of the DC voltage applied from the voltage applying device 14 is changed to change the average voltage of the developing bias voltage. Developing characteristics in a case where the distance d at which the image carrying member 1 and the developer carrying member 11 are opposite to each other is 0.12 mm and a case where it is 0.17 mm are examined. The results thereof in a case where the developing apparatus in the example C1 is used are shown in FIG. 23, the results thereof in a case where the developing apparatus in the example C2 is used are shown in FIG. 24, and the results thereof in a case where the developing apparatus in the comparative example c1 are shown in FIG. 25. In FIGS. 23 to 25, the result in a case where the distance d at which the image carrying member 1 and the developer carrying member 11 are opposite to each other is 0.12 mm is indicated by ○ and a broken line, and the result in a case where the distance d at which the image carrying member 1 and the developer carrying member 11 are opposite to each other is 0.17 mm is indicated by ● and a solid line.

As a result, when image densities in the case where the distance d at which the image carrying member 1 and the developer carrying member 11 are opposite to each other is 0.12 mm and the case where it is 0.17 mm are compared with each other in the vicinity of an image density of 1.5 at which an image having a sufficient density is obtained, the difference between the image densities in both the cases is large in the developing apparatus in the comparative example c1. Contrary to this, in each of the developing apparatuses in the examples C1 and C2, there is little difference between the image densities. Under conditions on which development is actually performed, even if the distance d at which the image carrying member 1 and the developer carrying member 11 are opposite to each other varies, the density of an image to be formed hardly becomes non-uniform. Accordingly, a good image having a constant image density is stably obtained.

(Embodiment 6)

Figure 26:
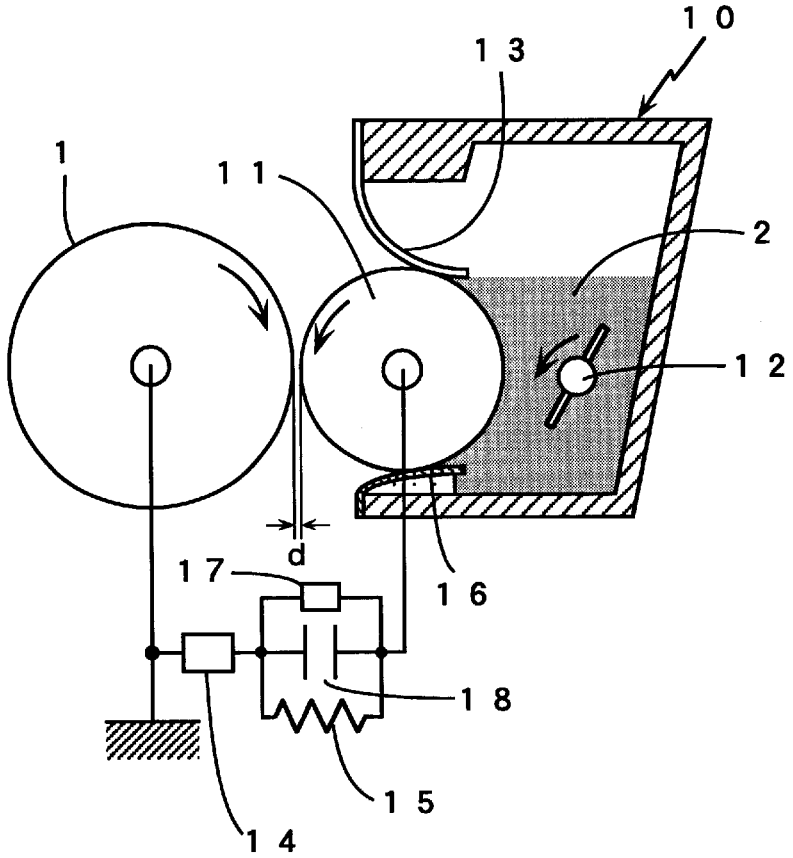
FIG. 26 is a schematic illustration of a developing apparatus according to an embodiment 6 in which a capacitor, a resistor and a rectifier element are connected in parallel between a voltage applying device and a developer carrying member.

Also in a developing apparatus according to an embodiment 6, a developer carrying member 11 in a roller shape is provided such that it is opposite to an image carrying member 1 at a required distance d, to supply toners 2 contained in an apparatus body 10 to the developer carrying member 11 by a supplying member 12, as in the developing apparatus shown in FIG. 10, as shown in FIG. 26.

The developer carrying member 11 is rotated, to convey the toners 2 supplied in the above-mentioned manner, and a regulating member 13 is pressed against the surface of the developer carrying member 11, to regulate the amount of the toners 2 to be conveyed as well as to subject the toners 2 to triboelectric charging. The toners 2 thus charged are introduced into a developing area opposite to the image carrying member 1 at the required distance d by the developer carrying member 11. The toners 2 are supplied to an electrostatic latent image formed on the image carrying member 1, to perform development. The same components as those in the developing apparatus according to the embodiment 1 are used as the developer carrying member 11 and the regulating member 13. The distance d at which the image carrying member 1 and the developer carrying member 11 are opposite to each other is generally set in the range of 150 to 250 μm.

In the developing apparatus according to the embodiment 6, a capacitor 18 having a capacitance of 100 to 1000 pF, a resistor 15 having a resistance value of $10^6$ to $10^9$Ω, and a rectifier element 17 such as a diode are connected in parallel between the developer carrying member 11 and a voltage applying device 14. The rectifier element 17 is connected in such a direction as to cut off a current caused by a voltage on the side of development which is exerted in the direction in which the toners 2 are fed to the image carrying member 1.

In the developing apparatus according to the embodiment 6, a developing bias voltage obtained by overlapping a DC voltage with an AC voltage composed of a rectangular wave is outputted, as indicated by broken lines in FIGS. 7(A) and 7(B), from the voltage applying device 14. The developing bias voltage is applied to the developer carrying member 11 through the capacitor 18, the resistor 15, and the rectifier element 17 which are connected in parallel. Consequently, the toners 2 held in the developer carrying member 11 are supplied to an electrostatic latent image formed on the image carrying member 1, to perform development.

Figure 27:
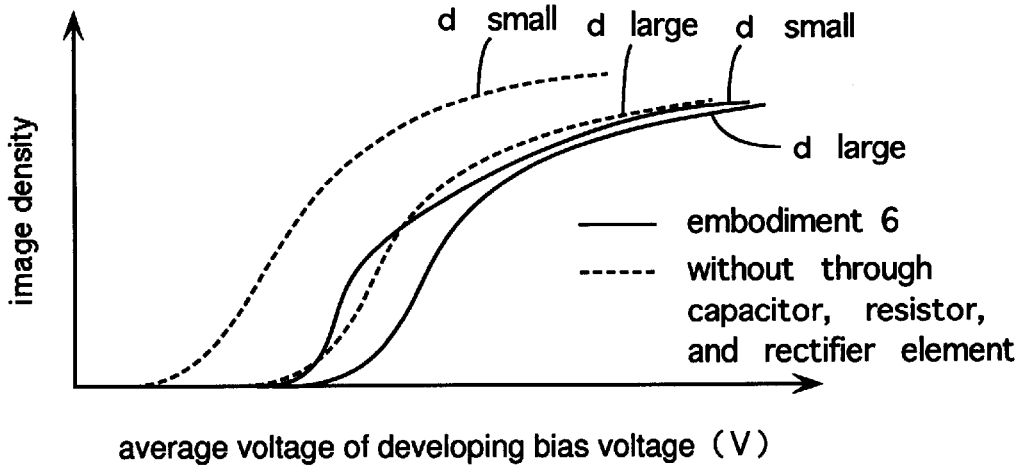
FIG. 27 is a diagram showing the results of comparison between changes in developing characteristics in a case where a distance at which an image carrying member and a developer carrying member are opposite to each other is large and a case where it is small in the developing apparatus according to the embodiment 6 and a developing apparatus so adapted that a developing bias voltage is directly applied to the developer carrying member from a voltage applying device.

In a case where the above-mentioned developing bias voltage is applied to the developer carrying member 11 through the capacitor 18, the resistor 15, and the rectifier element 17 which are connected in parallel to perform development, as in the developing apparatus according to the embodiment 6, and a case where the developing bias voltage is directly applied to the developer carrying member 11 to perform development, the voltage value of the DC voltage applied from the voltage applying device 14 is changed, to change the average voltage of the developing bias voltage. Developing characteristics in a case where the distance d at which the image carrying member 1 and the developer carrying member 11 are opposite to each other is large and a case where it is small are examined. The results thereof are shown in FIG. 27. In FIG. 27, the developing characteristics in the case where the developing bias voltage is applied to the developer carrying member 11 through the capacitor 18, the resistor 15, and the rectifier element 17 which are connected in parallel to perform development as in the developing apparatus according to the embodiment 6 are indicated by a solid line, and the developing characteristics in the case where the developing bias voltage is directly applied to the developer carrying member 11 to perform development are indicated by a broken line.

As a result, when the developing bias voltage is applied to the developer carrying member 11 through the capacitor 18, the resistor 15, and the rectifier element 17 which are connected in parallel to perform development, as in the developing apparatus according to the embodiment 6, the difference between image densities in a case where the distance d at which the image carrying member 1 and the developer carrying member 11 are opposite to each other is large and a case where it is small is made smaller, as compared with that in the case where the developing bias voltage is directly applied to the developer carrying member 11 to perform development. An image density is prevented from being changed in a case where the distance d at which the image carrying member 1 and the developer carrying member 11 are opposite to each other varies, thereby obtaining a good image which hardly becomes non-uniform in density and has a stable image density.

EXAMPLE D1 AND COMPARATIVE EXAMPLE d1

A developing apparatus in a specific example D1 according to the embodiment 6 and a developing apparatus in a comparative example d1 will be compared with each other, to clarify that an image density is prevented from being changed even when a distance at which an image carrying member and a developer carrying member are opposite to each other varies, thereby obtaining a good image which hardly becomes non-uniform in density in the developing apparatus in the example D1.

In the developing apparatus in the example D1, a capacitor 18 having a capacitance of 200 pF, a resistor 15 having a resistance value of 100 MΩ, and a rectifier element 17 are connected in parallel between the developer carrying member 11 and a voltage applying device 14 in the developing apparatus according to the embodiment 6 shown in FIG. 26, and the rectifier element 17 cuts off a current caused by a voltage on the side of development which is exerted in the direction in which toners 2 are fed to the image carrying member 1.

On the other hand, in the developing apparatus in the comparative example d1, a voltage applying device 14 is directly connected to a developer carrying member 11 without providing a capacitor 18, a resistor 15, and a rectifier element 17 between the voltage applying device 14 and the developer carrying member 11.

Figure 28:
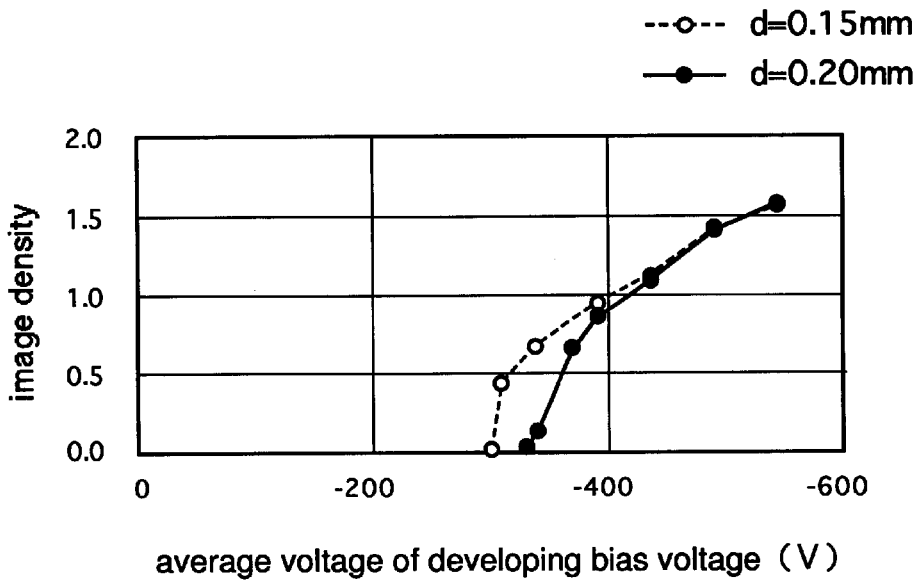
FIG. 28 is a diagram showing changes in developing characteristics in a case where a distance at which an image carrying member and a developer carrying member are opposite to each other is large and a case where it is small in a developing apparatus in a specific example D1 of the embodiment 6.
Figure 29:
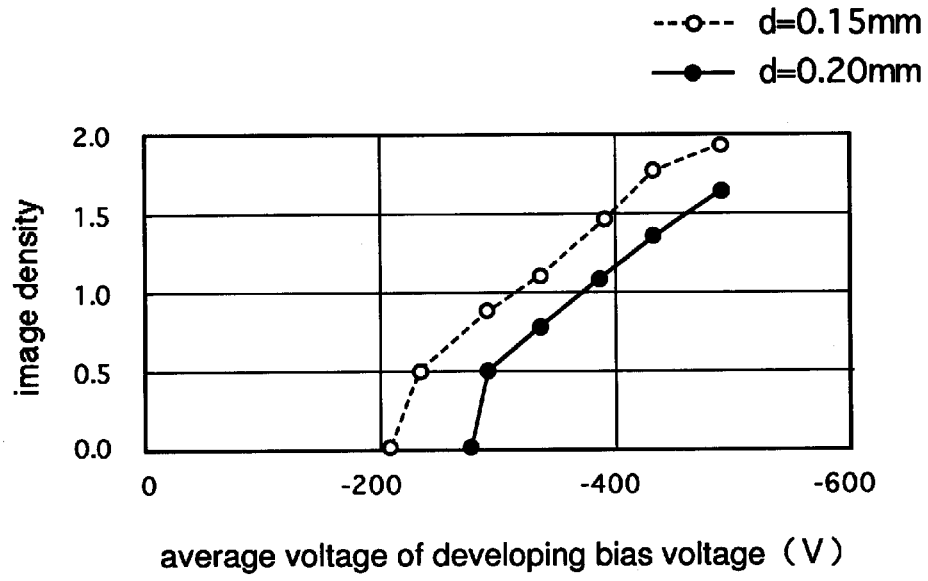
FIG. 29 is a diagram showing changes in developing characteristics in a case where a distance at which an image carrying member and a developer carrying member are opposite to each other is large and a case where it is small in a developing apparatus in a comparative example d1.

In each of the developing apparatuses in the example D1 and the comparative example d1, an AC voltage composed of a rectangular wave having a frequency of 2.6 kHz and having a peak-to-peak value Vpp of 2.0 kV in the example D1, while having a peak-to-peak value Vpp of 1.5 kV in the comparative example d1, together with a DC voltage, is outputted from the voltage applying device 14, and the voltage value of the DC voltage outputted from the voltage applying device 14 is changed, to change the average voltage of the developing bias voltage. Developing characteristics in a case where the distance d at which the image carrying member 1 and the developer carrying member 11 are opposite to each other is 0.15 mm and a case where it is 0.20 mm are examined. The results thereof in a case where the developing apparatus in the example D1 is used are shown in FIG. 28, and the results thereof in a case where the developing apparatus in the example d1 is used are shown in FIG. 29. In FIGS. 28 to 29, the result in a case where the distance d at which the image carrying member 1 and the developer carrying member 11 are opposite to each other is 0.15 mm is indicated by ○ and a broken line, and the result in a case where the distance d at which the image carrying member 1 and the developer carrying member 11 are opposite to each other is 0.20 mm is indicated by ● and a solid line.

As a result, when image densities in the case where the distance d at which the image carrying member 1 and the developer carrying member 11 are opposite to each other is 0.15 mm and the case where it is 0.20 mm are compared with each other in the vicinity of an image density of 1.5 at which an image having a sufficient density is obtained, the difference between the image densities in both the cases is large in the developing apparatus in the comparative example d1. Contrary to this, in the developing apparatus in the example D1, there is little difference between the image densities. Under conditions on which development is actually performed, even if the distance d at which the image carrying member 1 and the developer carrying member 11 are opposite to each other varies, the density of an image to be formed hardly becomes non-uniform. Accordingly, a good image having a constant image density is stably obtained.

(Embodiment 7)

In a developing apparatus according to an embodiment 7, a developer carrying member 11 in a roller shape is provided such that it is opposite to an image carrying member 1 at a required distance d, to supply toners 2 contained in an apparatus body 10 to the developer carrying member 11 by a supplying member 12, as in the developing apparatus according to the embodiment 1 shown in FIG. 10.

The developer carrying member 11 to which the toners 2 have been thus supplied is rotated, to convey the toners 2, and a regulating member 13 is pressed against the surface of the developer carrying member 11, to regulate the amount of the toners 2 to be conveyed as well as to subject the toners 2 to triboelectric charging. The toners 2 thus charged are introduced into a developing area opposite to the image carrying member 1 at the required distance d. The same components as those in the developing apparatus according to the embodiment 1 are used as the developer carrying member 11 and the regulating member 13.

Also in the developing apparatus according to the embodiment 7, there is provided a resistor 15 having a resistance value in the range of $10^3$ to $10^7\Omega$ between the developer carrying member 11 and a voltage applying device 14, as in the developing apparatus according to the embodiment 1 shown in FIG. 10.

In the developing apparatus according to the embodiment 7, a developing bias voltage obtained by overlapping a DC voltage with an AC voltage composed of a rectangular wave and having a pulse shape in which a voltage on the side of development which is exerted in the direction in which the toners 2 are fed to the image carrying member 1 is continuously decreased from its peak value, while a voltage on the side of recovery which is exerted in the direction in which the toners 2 are returned to the developer carrying member 11 is composed of a rectangular wave is outputted, as indicated by broken lines in FIGS. 8(A) and 8(B), from the voltage applying device 14, and the developing bias voltage is applied to the developer carrying member 11 through the resistor 15. Consequently, the toners 2 held in the developer carrying member 11 are supplied to an electrostatic latent image formed on the image carrying member 1, to perform development.

Figure 30:
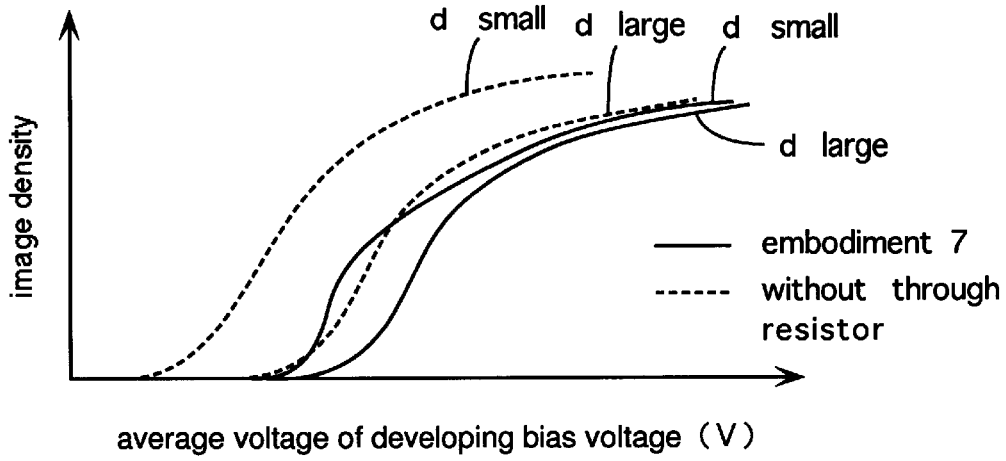
FIG. 30 is a diagram showing the results of comparison between changes in developing characteristics in a case where a distance at which an image carrying member and a developer carrying member are opposite to each other is large and a case where it is small in a developing apparatus according to an embodiment 7 in which a resistor is provided between a voltage applying device and a developer carrying member and a developing apparatus so adapted that a developing bias voltage is directly applied to the developer carrying member from a voltage applying device.

In a case where the above-mentioned developing bias voltage is applied to the developer carrying member 11 from the voltage applying device 14 through the resistor 15 to perform development, as in the developing apparatus according to the embodiment 7, and a case where the developing bias voltage is directly applied to the developer carrying member 11 without through the resistor 15 to perform development, the voltage value of the DC voltage applied from the voltage applying device 14 is changed, to change the average voltage of the developing bias voltage. Developing characteristics in a case where the distance d at which the image carrying member 1 and the developer carrying member 11 are opposite to each other is large and a case where it is small are examined. The results thereof are shown in FIG. 30. In FIG. 30, the developing characteristics in the case where the developing bias voltage is applied to the developer carrying member 11 through the resistor 15 to perform development as in the developing apparatus according to the embodiment 7 are indicated by a solid line, and the developing characteristics in the case where the developing bias voltage is directly applied to the developer carrying member 11 without through the resistor 15 to perform development are indicated by a broken line.

As a result, when the developing bias voltage is applied to the developer carrying member 11 through the resistor 15 to perform development, as in the developing apparatus according to the embodiment 7, the difference between image densities in a case where the distance d at which the image carrying member 1 and the developer carrying member 11 are opposite to each other is large and a case where it is small is made smaller, as compared with that in the case where the developing bias voltage is directly applied to the developer carrying member 11 without through the resistor 15 to perform development. An image density is prevented from being changed in a case where the distance d at which the image carrying member 1 and the developer carrying member 11 are opposite to each other varies, thereby obtaining a good image which hardly becomes non-uniform in density and has a stable image density.

Although in the developing apparatus according to the embodiment 7, the resistor 15 having a resistance value in the range of $10^3$ to $10^7\Omega$ is provided between the developer carrying member 11 and the voltage applying device 14 for supplying the developing bias voltage, there may be provided a variable resistor 15*a* whose resistance value can be varied between the developer carrying member 11 and the voltage applying device 14 and a sensor 15*b* for detecting the toner density of a toner image formed on the developer carrying member 11 in close proximity to the developer carrying member 11, as shown in FIG. 12, thereby making it possible to change the resistance value of the variable resistor 15*a* by a control device 15*c* on the basis of the toner density measured by the sensor 15*b*.

(Embodiment 8)

In a developing apparatus according to an embodiment 8, a resistor layer 11*a* having a resistance value in the range of $10^3$ to $10^7\Omega$ is provided on the surface of a developer carrying member 11, as in the developing apparatus according to the embodiment 2 shown in FIG. 13, instead of providing a resistor 15 between the developer carrying member 11 and a voltage applying device 14 for supplying a developing bias voltage, as in the developing apparatus according to the embodiment 7. Used as the developer carrying member 11 is one provided with a resistor layer 110 using a conductive roller such as a metal roller and composed of a rubber material such as EPDM, silicon rubber, or urethane rubber, or a resin material such as polystyrene, polyolefin, polyurethane, polyester, polyvinyl chloride, polybutadiene, or polyamide on the surface of the developer carrying member 11, as in the developing apparatus according to the embodiment 2.

A developing bias voltage obtained by overlapping a DC voltage with an AC voltage having a pulse shape in which a voltage on the side of development which is exerted in the direction in which toners 2 are fed to the image carrying member 1 is continuously decreased from its peak value, while a voltage on the side of recovery which is exerted in the direction in which the toners 2 are returned to the developer carrying member 11 is composed of a rectangular wave is outputted, as indicated by broken lines in FIGS. 8(A) and 8(B), as in the developing apparatus according to the embodiment 7, to the developer carrying member 11 thus provided with the resistor layer 11*a* from the voltage applying device 14, and the developing bias voltage is applied to the developer carrying member 11 provided with the resistor layer 11*a*, as described above. Consequently, the toners 2 held in the developer carrying member 11 are supplied to an electrostatic latent image formed on the image carrying member 1, to perform development.

When the development is thus performed, the difference between image densities in a case where a distance d at which the image carrying member 1 and the developer carrying member 11 are opposite to each other is large and a case where it is small becomes smaller, as in the above-mentioned embodiment 7. An image density is prevented from being changed in a case where the distance d at which the image carrying member 1 and the developer carrying member 11 are opposite to each other varies, thereby obtaining a good image which hardly becomes non-uniform in density and has a stable image density.

(Embodiment 9)

In a developing apparatus according to an embodiment 9, a resistor 15 having a resistance value in the range of $10^6$ to $10^9\Omega$ and a rectifier element 17 such as a diode are connected in parallel between a developer carrying member 11 and a voltage applying device 14, and the rectifier element 17 is connected in such a direction as to cut off a current caused by a voltage on the side of development which is exerted in the direction in which toners 2 are fed to the image carrying member, as in the developing apparatus according to the embodiment 3 shown in FIG. 17.

Also in the developing apparatus according to the embodiment 9, a developing bias voltage obtained by overlapping a DC voltage with an AC voltage having a pulse shape in which a voltage on the side of development which is exerted in the direction in which the toners 2 are fed to an image carrying member 1 is continuously decreased from its peak value, while a voltage on the side of recovery which is exerted in the direction in which the toners 2 are returned to the developer carrying member 11 is composed of a rectangular wave is outputted, as indicated by broken lines in FIGS. 8(A) and 8(B), from the voltage applying device 14, and the developing bias voltage is applied to the developer carrying member 11 through the resistor 15 and the rectifier element 17 which are connected in parallel, as in the developing apparatus according to the embodiment 7. Consequently, the toners 2 held in the developer carrying member 11 are supplied to an electrostatic latent image formed on the image carrying member 1, to perform development.

Although in the developing apparatuses according to the embodiments 7 to 9, an AC voltage, as indicated by broken lines in FIGS. 8(A) and 8(B), is outputted as the AC voltage in the developing bias voltage from the voltage applying device 14, the AC voltage outputted from the voltage applying device 14 is not limited to the same.

Figure 31:
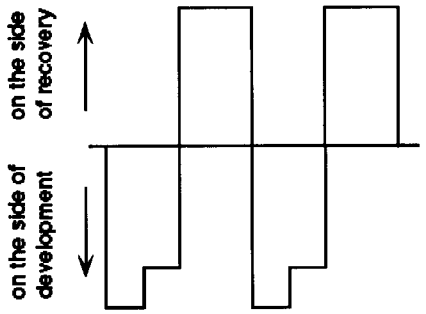
FIGS. 31(A) and 31(B) are diagrams showing two modified examples of an AC voltage outputted from a voltage applying device in developing apparatuses according to embodiments 7 to 9.
Figure 31:
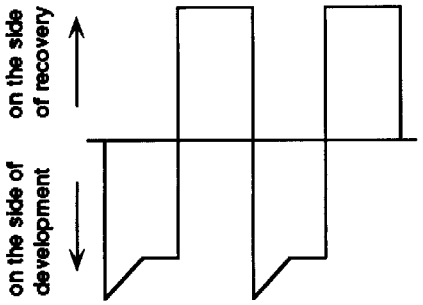

It is possible to use, as the AC voltage outputted from the voltage applying device 14, a pulse-shaped AC voltage in which a voltage on the side of development which is exerted in the direction in which the toners 2 are fed to the image carrying member 1 is gradually decreased from its peak value, while a voltage on the side of recovery which is exerted in the direction in which the toners 2 are returned to the developer carrying member 11 is composed of a rectangular wave, as shown in FIG. 31(A), and a pulse-shaped AC voltage in which a voltage on the side of development which is exerted in the direction in which the toners 2 are fed to the image carrying member 1 is continuously decreased from its peak value to a certain potential, while a voltage on the side of recovery which is exerted in the direction in which the toners 2 are returned to the developer carrying member 11 is composed of a rectangular wave, as shown in FIG. 31(B).

Figure 32:
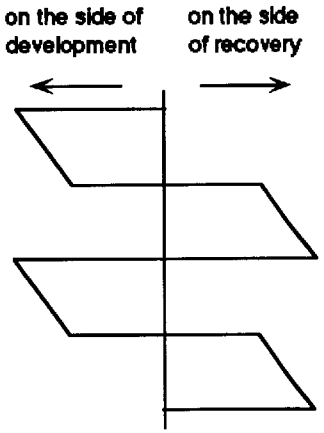
FIGS. 32(A), 32(B), and 32(c) are diagrams showing three modified examples of the AC voltage outputted from the voltage applying device in the developing apparatuses according to the embodiments 7 to 9.
Figure 32:
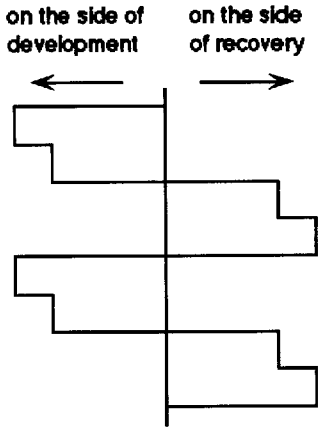
Figure 32:
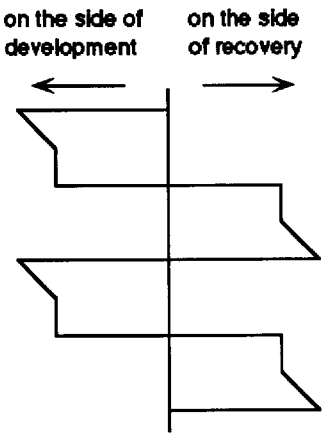

It is also possible to use a pulse-shaped AC voltage in which a voltage on the side of development which is exerted in the direction in which the toners 2 are fed to the image carrying member 1 is continuously decreased from its peak value, while a voltage on the side of recovery which is exerted in the direction in which the toners 2 are returned to the developer carrying member 11 is continuously increased to its peak value, as shown in FIG. 32(A), a pulse-shaped AC voltage in which a voltage on the side of development which is exerted in the direction in which the toners 2 are fed to the image carrying member 1 is gradually decreased from its peak value, while a voltage on the side of recovery which is exerted in the direction in which the toners 2 are returned to the developer carrying member 11 is gradually increased to its peak value, as shown in FIG. 32(B), and a pulse-shaped AC voltage in which a voltage on the side of development which is exerted in the direction in which the toners 2 are fed to the image carrying member 1 is continuously decreased from its peak value to a certain potential, while a voltage on the side of recovery which is exerted in the direction in which the toners 2 are returned to the developer carrying member 11 is continuously increased from a certain potential to its peak value, as shown in FIG. 32(C).

Figure 33:
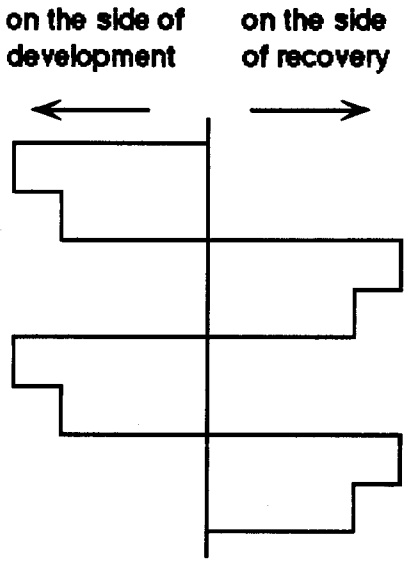
FIGS. 33(A) and 33(B) are diagrams showing two modified examples of the AC voltage outputted from the voltage applying device in the developing apparatuses according to the embodiments 7 to 9.
Figure 33:
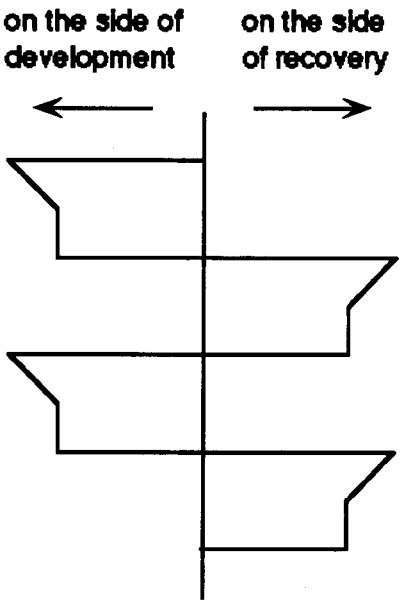

It is also possible to use a pulse-shaped AC voltage in which a voltage on the side of development which is exerted in the direction in which the toners 2 are fed to the image carrying member 1 and a voltage on the side of recovery which is exerted in the direction in which the toners 2 are returned to the developer carrying member 11 are continuously decreased from their respective peak values, as indicated by broken lines in FIGS. 9(A) and 9(B), a pulse-shaped AC voltage in which a voltage on the side of development which is exerted in the direction in which the toners 2 are fed to the image carrying member 1 and a voltage on the side of recovery which is exerted in the direction in which the toners 2 are returned to the developer carrying member 11 are gradually decreased from their respective peak values, as shown in FIG. 33(A), and a pulse-shaped AC voltage in which a voltage on the side of development which is exerted in the direction in which the toners 2 are fed to the image carrying member 1 and a voltage on the side of recovery which is exerted in the direction in which the toners 2 are returned to the developer carrying member 11 are continuously and gradually decreased from their respective peak values to certain potentials, as shown in FIG. 33(B).

Figure 34:
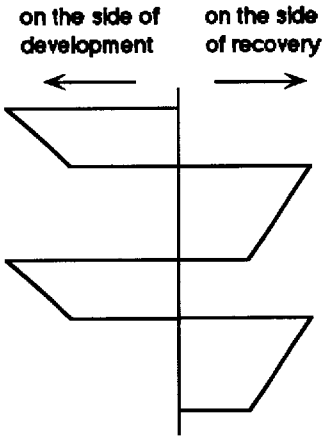
FIGS. 34(A), 34(B), and 34(c) are diagrams showing three modified examples of the AC voltage outputted from the voltage applying device in the developing apparatuses according to the embodiments 7 to 9.
Figure 34:
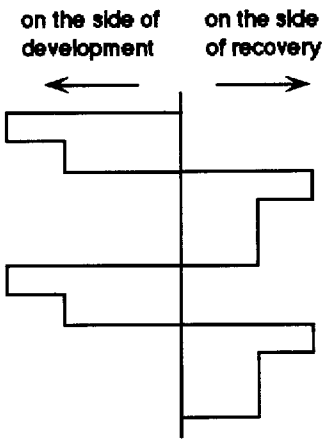
Figure 34:
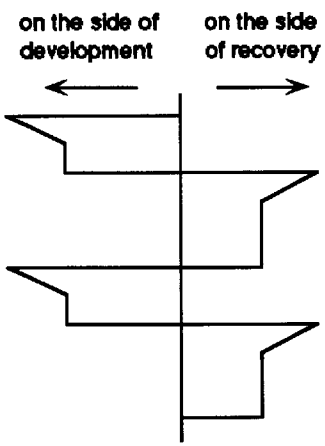

It is also possible to use a pulse-shaped AC voltage in which a voltage on the side of development which is exerted in the direction in which the toners 2 are fed to the image carrying member 1 and a voltage on the side of recovery which is exerted in the direction in which the toners 2 are returned to the developer carrying member 11 are continuously decreased from their respective peak values and the voltage on the side of development is exerted for a short time period, as shown in FIG. 34(A), a pulse-shaped AC voltage in which a voltage on the side of development which is exerted in the direction in which the toners 2 are fed to the image carrying member 1 and a voltage on the side of recovery which is exerted in the direction in which the toners 2 are returned to the developer carrying member 11 are gradually decreased from their respective peak values and the voltage on the side of development is exerted for a short time period, as shown in FIG. 34(B), and a pulse-shaped AC voltage in which a voltage on the side of development which is exerted in the direction in which the toners 2 are fed to the image carrying member 1 and a voltage on the side of recovery which is exerted in the direction in which the toners 2 are returned to the developer carrying member 11 are continuously decreased from their respective peak values to certain potentials and the voltage on the side of development is exerted for a short time period, as shown in FIG. 34(B).

EXAMPLES E1 AND E2 AND COMPARATIVE EXAMPLE e1

Developing apparatuses in specific examples E1 and E2 according to the embodiment 7 and a developing apparatus in a comparative example e1 will be compared with each other, to clarify that an image density is prevented from being changed even when a distance at which an image carrying member and a developer carrying member are opposite to each other varies, thereby obtaining a good image which hardly becomes non-uniform in density in the developing apparatuses in the examples E1 and E2.

In each of the developing apparatuses in the examples E1 and E2, a resistor 15 having a resistance value of 600 kΩ is provided between a developer carrying member 11 and a voltage applying device 14 in the developing apparatus according to the embodiment 7. On the other hand, a developer carrying member 11 which is not provided with a resistor layer 11*a* is used, and a resistor 15 is not provided between the developer carrying member 11 and a voltage applying device 14 in the developing apparatus in the comparative example e1.

In the developing apparatus in the example E1, a DC voltage as well as a pulse-shaped AC voltage which has a peak-to-peak value Vpp of 1.5 kV and has a frequency of 2.6 kHz and in which a voltage on the side of development and a voltage on the side of recovery are continuously decreased from their respective peak values and the voltage on the side of development is exerted for a time period which is 30% of a time period during which the AC voltage is exerted, as shown in FIG. 34(A), are applied to the developer carrying member 11 through the resistor 15.

In the developing apparatus in the example E2, a DC voltage as well as a pulse-shaped AC voltage which has a peak-to-peak value Vpp of 1.5 kV and has a frequency of 2.6 kHz and in which a voltage on the side of development is continuously decreased from its peak value, while a voltage on the side of recovery is composed of a rectangular wave, and the voltage on the side of development is exerted for a time period which is 30% of a time period during which the AC voltage is exerted, as indicated by broken lines in FIGS. 8(A) and 8(B), are applied to the developer carrying member 11 from the voltage applying device 14 through the resistor 15.

On the other hand, in the developing apparatus in the comparative example e1, a DC voltage as well as a pulse-shaped AC voltage composed of a rectangular wave having a peak-to-peak value Vpp of 1.5 kV and having a frequency of 2.6 kHz and including a voltage on the side of development which is exerted for a time period which is 30% of a time period during which the AC voltage is exerted are directly applied to the developer carrying member 11 from the voltage applying device 14.

Figure 35:
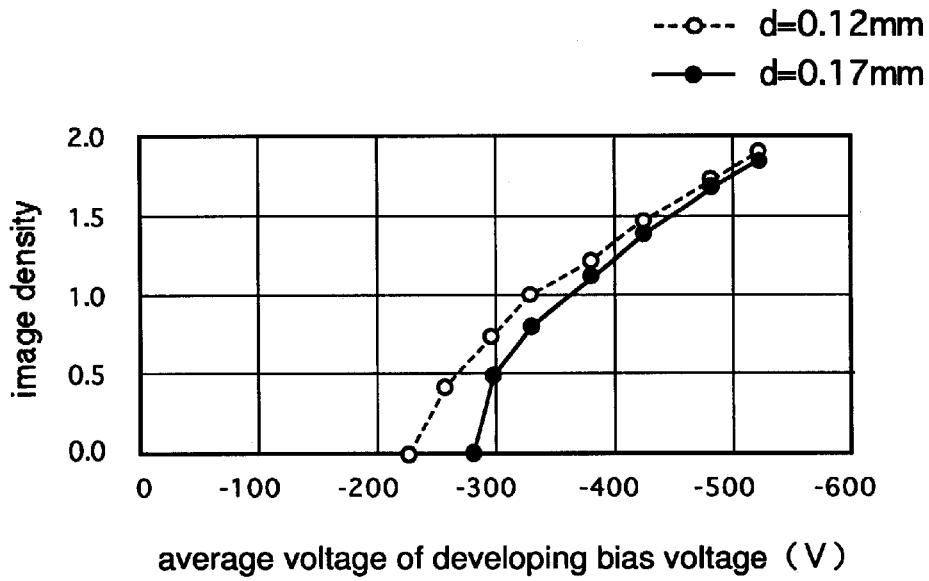
FIG. 35 is a diagram showing changes in developing characteristics in a case where a distance at which an image carrying member and a developer carrying member are opposite to each other is large and a case where it is small in a developing apparatus in a specific example E1 of the embodiment 7.
Figure 36:
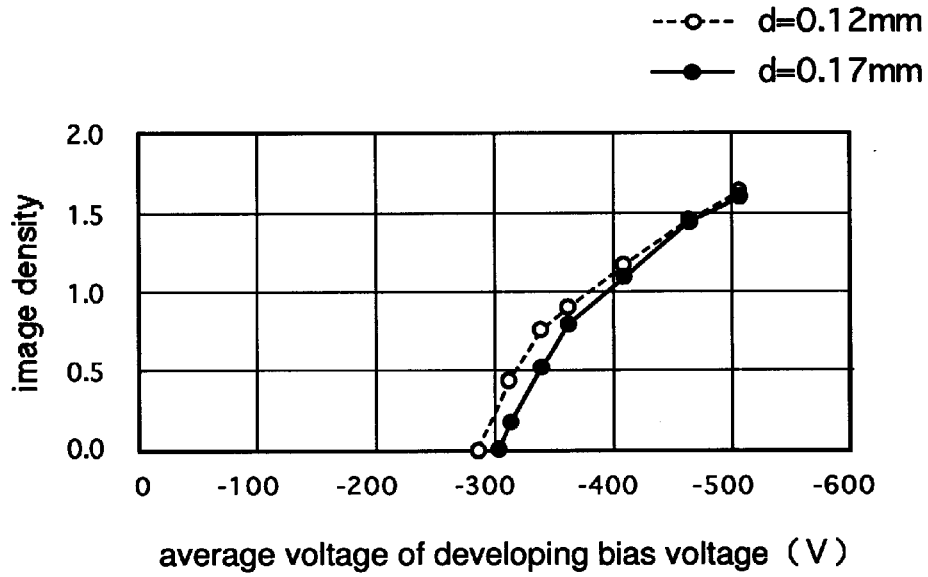
FIG. 36 is a diagram showing changes in developing characteristics in a case where a distance at which an image carrying member and a developer carrying member are opposite to each other is large and a case where it is small in a developing apparatus in a specific example E2 of the embodiment 7.
Figure 37:
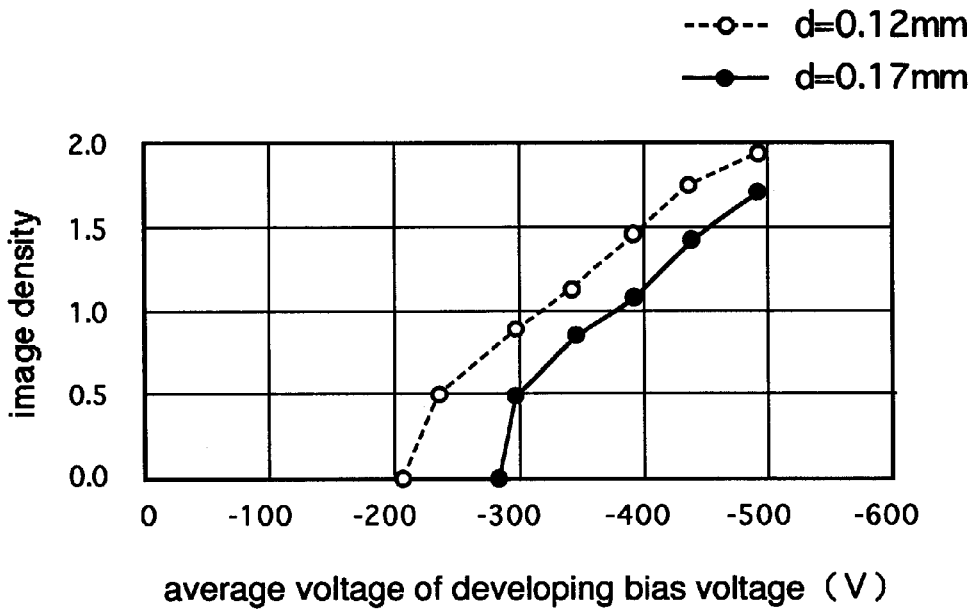
FIG. 37 is a diagram showing changes in developing characteristics in a case where a distance at which an image carrying member and a developer carrying member are opposite to each other is large and a case where it is small in a developing apparatus in a comparative example e1.

In each of the developing apparatuses in the examples E1 and E2 and the comparative example e1, the voltage value of the DC voltage applied from the voltage applying device 14 is changed, to change the average voltage of the developing bias voltage. Developing characteristics in a case where the distance d at which the image carrying member 1 and the developer carrying member 11 are opposite to each other is 0.12 mm and a case where it is 0.17 mm are examined. The results thereof in a case where the developing apparatus in the example E1 is used are shown in FIG. 35, the results thereof in a case where the developing apparatus in the example E2 is used are shown in FIG. 36, and the results thereof in a case where the developing apparatus in the comparative example e1 is used are shown in FIG. 37. In FIGS. 35 to 37, the result in a case where the distance d at which the image carrying member 1 and the developer carrying member 11 are opposite to each other is 0.12 mm is indicated by ○ and a broken line, and the result in a case where the distance d at which the image carrying member 1 and the developer carrying member 11 are opposite to each other is 0.17 mm is indicated by ● and a solid line.

As a result, when image densities in the case where the distance d at which the image carrying member 1 and the developer carrying member 11 are opposite to each other is 0.12 mm and the case where it is 0.17 mm are compared with each other in the vicinity of an image density of 1.5 at which an image having a sufficient density is obtained, the difference between the image densities in both the cases is large in the developing apparatus in the comparative example e1. Contrary to this, in each of the developing apparatuses in the examples E1 and E2, there is little difference between the image densities. Under conditions on which development is actually performed, even if the distance d at which the image carrying member 1 and the developer carrying member 11 are opposite to each other varies, the density of an image to be formed hardly becomes non-uniform. Accordingly, a good image having a constant image density is stably obtained.

Although in the developing apparatuses in the examples E1 and E2, an example using the developing apparatus according to the embodiment 7 as shown in FIG. 10 is illustrated, the same results as those in the developing apparatuses in the examples E1 and E2 are obtained even when a resistor layer 11*a* having a resistance value of 1.5 MΩ is provided on the surface of the developer carrying member in the developing apparatus according to the embodiment 8 shown in FIG. 13, and the same developing bias voltage as those in the examples E1 and E2 is applied to the developer carrying member 11.

Although the present invention has been fully described by way of examples, it is to be noted that various changes and modification will be apparent to those skilled in the art.

Therefore, unless otherwise such changes and modifications depart from the scope of the present invention, they should be construed as being included therein.

What is claimed is:

1. A developing apparatus for developing an electrostatic latent image formed on an image carrying member, comprising:

a developer carrying member for holding a developer and introducing the developer into a developing area, the developer carrying member arranged opposite to the image carrying member at a distance;

a voltage applying device for applying an AC voltage composed of a rectangular wave to the developer carrying member; and a resistor inserted between the voltage applying device and the developer carrying member, the resistor having a resistance value of $10^3$ to $10^7\Omega$:

the AC voltage having a first time period during which a first voltage is exerted in a first direction in which the developer is fed to the image carrying member and a second time period during which a second voltage is exerted in a second direction in which the developer is returned to the developer carrying member, the first time period being shorter than the second time period.

2. The developing apparatus according to claim 1, wherein the developer is toner, the developing device comprising a regulating member for regulating an amount of the toner on the developer carrying member, the regulating member being arranged in contact with the developer carrying member.

3. A developing apparatus for developing an electrostatic latent image formed on an image carrying member, comprising:

a developer carrying member for holding a developer and introducing the developer into a developing area, the developer carrying member arranged opposite to the image carrying member at a distance, said developer carrying member having a resistor layer which is composed of a rubber material or resin material; and a voltage applying device for applying an AC voltage composed of a rectangular wave to the developer carrying member;

the AC voltage having a first time period during which a first voltage is exerted in a first direction in which the developer is fed to the image carrying member and a second time period during which a second voltage is exerted in a second direction in which the developer is returned to the developer carrying member, the first time period being shorter than the second time period.

4. The developing apparatus according to claim 3, wherein a resistance value of the resistor layer is in the range of $10^3$ to $10^7\Omega$.

5. The developing apparatus according to claim 3, wherein the developer is toner, the developing device comprising a regulating member for regulating an amount of the toner on the developer carrying member, the regulating member being arranged in contact with the developer carrying member.

6. A developing apparatus for developing an electrostatic latent image formed on an image carrying member, comprising:

a developer carrying member for holding a developer and introducing the developer into a developing area, the developer carrying member arranged opposite to the image carrying member at a required distance; and a voltage applying device for applying an AC voltage composed of a rectangular wave to the developer carrying member, a resistor and a rectifier element being connected in parallel between said voltage applying device and the developer carrying member, and the rectifier element being connected in such a direction as to cut off a current caused by a voltage which is exerted in a direction in which the developer is fed to the image carrying member.

7. The developing apparatus according to claim 6, wherein a resistance value of said resistor is in the range of $10^3$ to $10^7\Omega$.

8. The developing apparatus according to claim 6, wherein the developer is toner, the developing device comprising a regulating member for regulating an amount of the toner on the developer carrying member, the regulating member being arranged in contact with the developer carrying member.

9. A developing apparatus for developing an electrostatic latent image formed on an image carrying member, comprising:

a developer carrying member for holding a developer and introducing the developer into a developing area, the developer carrying member arranged opposite to the image carrying member at a distance;

a voltage applying device for applying an AC voltage composed of a rectangular wave to the developer carrying member; and a resistor inserted between the voltage applying device and the developer carrying member, the resistor having a resistance value of $10^3$ to $10^7\Omega$:

the AC voltage having a constant voltage period during which there is no voltage change, a first time period during which a first voltage is exerted in a first direction in which the developer is returned to the developer carrying member and a second time period during which a second voltage is exerted in a second direction in which the developer is fed to the image carrying member, the constant voltage period existed between the first time period and the second time period when the AC voltage is changed from the first voltage to the second voltage.

10. The developing apparatus according to claim 9, wherein the developer is toner, the developing device comprising a regulating member for regulating an amount of the toner on the developer carrying member, the regulating member being arranged in contact with the developer carrying member.

11. A developing apparatus for developing an electrostatic latent image formed on an image carrying member, comprising:

a developer carrying member for holding a developer and introducing the developer into a developing area, the developer carrying member arranged opposite to the image carrying member at a distance, said developer carrying member having a resistor layer which is composed of a rubber material or a resin material; and a voltage applying device for applying an AC voltage composed of a rectangular wave to the developer carrying member:

the AC voltage having a constant voltage period during which there is no voltage change, a first time period during which a first voltage is exerted in a first direction in which the developer is returned to the developer carrying member and a second time period during which a second voltage is exerted in a second direction in which the developer is fed to the image carrying member, the constant voltage period existed between the first time period and the second time period when the AC voltage is changed from the first voltage to the second voltage.

12. The developing apparatus according to claim 11, wherein the resistance value of the resistor layer is in the range of $10^3$ to $10^7\Omega$.

13. The developing apparatus according to claim 11, wherein the developer is toner, the developing device comprising a regulating member for regulating an amount of the toner on the developer carrying member, the regulating member being arranged in contact with the developer carrying member.

14. A developing apparatus for developing an electrostatic latent image formed on an image carrying member, comprising:

a developer carrying member for holding a developer and introducing the developer into a developing area, the developer carrying member arranged opposite to the image carrying member at a required distance; and a voltage applying device for applying an AC voltage composed of a rectangular wave to the developer carrying member, a capacitor, a resistor, and a rectifier element being connected in parallel between said voltage applying device and the developer carrying member, and the rectifier element being connected in such a direction as to cut oft a current caused by a voltage which is exerted in a direction in which the developer is fed to the image carrying member.

15. The developing apparatus according to claim 14, wherein the developer is toner, the developing device comprising a regulating member for regulating an amount of the toner on the developer carrying member, the regulating member being arranged in contact with the developer carrying member.

16. A developing apparatus for developing an electrostatic latent image formed on an image carrying member, comprising:

a developer carrying member for holding a developer and introducing the developer into a developing area, the developer carrying member arranged opposite to the image carrying member at a distance;

a voltage applying device for applying an AC voltage to the developer carrying member, a voltage waveform of the AC voltage consisting of straight line portions; and a resistor inserted between the voltage applying device and the developer carrying member, the resistor having a resistance value of $10^3$ to $10^7\Omega$:

the AC voltage having a first voltage which is exerted in a first direction in which the developer is fed to the image carrying member and a second voltage which is exerted in a second direction in which the developer is returned to the developer carrying member, the first voltage being continuously or stepwise changed from its peak value.

17. The developing apparatus according to claim 16, wherein the second voltage is continuously or stepwise changed from its peak value.

18. The developing apparatus according to claim 16, wherein a first time period during which the first voltage is exerted is shorter than a second time period during which the second voltage is exerted.

19. The developing apparatus according to claim 16, wherein the developer is toner, the developing device comprising a regulating member for regulating an amount of the toner on the developer carrying member, the regulating member being arranged in contact with the developer carrying member.

20. The developing apparatus according to claim 16, wherein a resistor and a rectifier element are connected in parallel between said voltage applying device and the developer carrying member, and the rectifier element is connected in such a direction as to cut off a current caused by the first voltage.

21. A developing apparatus for developing an electrostatic latent image formed on an image carrying member, comprising:

a developer carrying member for holding a developer and introducing the developer into a developing area opposite to the image carrying member at a required distance;

a voltage applying device for applying an AC voltage to the developer carrying member; and a resistor inserted between the voltage applying device and the developer carrying member;

the AC voltage applied to the developer carrying member from said voltage applying device through the resistor being a pulse-shaped AC voltage, and at least a voltage on the side of development, which is exerted in the direction in which the developer is fed to the image carrying member, in the AC voltage being continuously or gradually decreased from its peak value:

wherein a resistor and a rectifier element are connected in parallel between said voltage applying device and the developer carrying member, and the rectifier element is connected in such a direction as to cut off a current caused by a voltage on the side of development, which is exerted in the direction in which the developer is fed to the image carrying member, in said pulse-shaped AC voltage.

22. A developing apparatus for developing an electrostatic latent image formed on an image carrying member, comprising:

a developer carrying member for holding a developer and introducing the developer into a developing area, the developer carrying member arranged opposite to the image carrying member at a distance, said developer carrying member having a resistor layer which is composed of a rubber material or resin material; and a voltage applying device for applying an AC voltage to the developer carrying member, a voltage waveform of the AC voltage consisting of straight line portions;

the AC voltage having a first voltage which is exerted in a first direction in which the developer is fed to the image carrying member and a second voltage which is exerted in a second direction in which the developer is returned to the developer carrying member, the first voltage being continuously or stepwise changed from its peak value.

23. The developing apparatus according to claim 22, wherein the second voltage is continuously or stepwise changed from its peak value.

24. The developing apparatus according to claim 22, wherein a first time period during which the first voltage is exerted is shorter than a second time period during which the second voltage is exerted.

25. The developing apparatus according to claim 22, wherein the developer is toner, the developing device comprising a regulating member for regulating an amount of the toner on the developer carrying member, the regulating member being arranged in contact with the developer carrying member.

26. The developing apparatus according to claim 22, wherein a resistor and a rectifier element are connected in parallel between said voltage applying device and the developer carrying member, and the rectifier element is connected in such a direction as to cut off a current caused by the first voltage.

27. A developing apparatus for developing an electrostatic latent image formed on an image carrying member, comprising:

a developer carrying member for holding a developer and introducing the developer into a developing area opposite to the image carrying member at a required distance; and a voltage applying device for applying an AC voltage to the developer carrying member;

said developer carrying member being provided with a resistor layer, the AC voltage applied to the developer carrying member provided with the resistor layer from said voltage applying device being a pulse-shaped AC voltage, and at least a voltage on the side of development, which is exerted in the direction in which the developer is fed to the image carrying member, in the AC voltage being continuously or gradually decreased from its peak value;

wherein a resistor and a rectifier element are connected in parallel between said voltage applying device and the developer carrying member, and the rectifier element is connected in such a direction as to cut off a current caused by the voltage on the side of development, which is exerted in the direction in which the developer is fed to the image carrying member, in said pulse-shaped AC voltage.

* * * * *